US008052309B2

(12) United States Patent
Dyson

(10) Patent No.: US 8,052,309 B2
(45) Date of Patent: Nov. 8, 2011

(54) LIGHTING SYSTEM WITH REFLECTOR THAT MOVES IN A PERIODIC MANNER

(76) Inventor: Jacob Dyson, London (GB)

( * ) Notice: Subject to any disclaimer, the term of this patent is extended or adjusted under 35 U.S.C. 154(b) by 353 days.

(21) Appl. No.: 12/302,514

(22) PCT Filed: May 31, 2007

(86) PCT No.: PCT/GB2007/002006

§ 371 (c)(1),
(2), (4) Date: Jan. 16, 2009

(87) PCT Pub. No.: WO2007/138321

PCT Pub. Date: Dec. 6, 2007

(65) Prior Publication Data

US 2009/0201682 A1 Aug. 13, 2009

(30) Foreign Application Priority Data

May 31, 2006 (GB) ..... 0610761.9

(51) Int. Cl.
*F21V 7/00* (2006.01)

(52) U.S. Cl. ..... 362/308; 362/187; 362/324; 362/468; 359/196.1; 359/197.1

(58) Field of Classification Search ..... 362/39, 362/53, 55, 460, 469, 509, 516, 517, 518, 362/519, 520, 523, 524, 539, 174, 177, 187, 362/197, 199, 214, 215, 217.02, 217.04, 362/217.05, 217.06, 235, 244, 245, 246, 362/285, 287, 296.01, 297, 299, 308, 310, 362/296.03, 296.08, 311.07, 341, 343, 347, 362/348, 16, 17, 18, 319, 321, 326, 327, 362/35, 277–284, 322–324, 464–468, 512–515; 359/196.1, 197.1, 198.1, 199.1
See application file for complete search history.

(56) References Cited

U.S. PATENT DOCUMENTS 1,423,253 A * 7/1922 Post ..... 362/321
1,545,009 A * 7/1925 Paine ..... 404/16
1,706,836 A 3/1929 Arbuckle (Continued)

FOREIGN PATENT DOCUMENTS

DE 29808427 U1 7/1998

(Continued)

OTHER PUBLICATIONS

International Search Report and Written Opinion for related Application No. PCT/GB2007/002006. (ISR/WO).

(Continued)

*Primary Examiner* — Anabel Ton
*Assistant Examiner* — Danielle Allen
(74) *Attorney, Agent, or Firm* — Stephen B. Selai; Brian B. Shaw; Harter Secrest & Emery LLP

(57) ABSTRACT

The present invention concerns lighting systems and particularly active lighting systems which are capable of providing automated changing lighting effects. The lighting system comprises a light source (50), a deflector (10) positioned within the path of light emitted by the light source, and a reflector (20) wherein at least one of the reflector and defector is moveable relative to the other of the reflector and the defector.

17 Claims, 25 Drawing Sheets

U.S. PATENT DOCUMENTS

| | | | | | |
|---|---|---|---|---|---|
| 1,967,342 | A | * | 7/1934 | Upmeyer | 362/509 |
| 2,059,762 | A | * | 11/1936 | Townsend | 362/516 |
| 2,275,621 | A | * | 3/1942 | Gardinor | 362/29 |
| 2,607,839 | A | | 8/1952 | Heehler | |
| 3,700,883 | A | * | 10/1972 | Donohue et al. | 362/518 |
| 3,877,171 | A | * | 4/1975 | Sloop et al. | 446/485 |
| 4,037,096 | A | * | 7/1977 | Brendgord et al. | 362/294 |
| 4,663,696 | A | * | 5/1987 | Miyazawa et al. | 362/465 |
| 5,105,347 | A | | 4/1992 | Ruud et al. | |
| 5,251,110 | A | | 10/1993 | Leleve | |
| 5,272,408 | A | * | 12/1993 | Levin et al. | 313/113 |
| 5,367,349 | A | * | 11/1994 | Zeiler | 353/43 |
| 5,582,479 | A | | 12/1996 | Thomas et al. | |
| 5,582,480 | A | * | 12/1996 | Zwick et al. | 362/298 |
| 5,791,768 | A | | 8/1998 | Splane, Jr. | |
| 5,803,571 | A | * | 9/1998 | McEntyre et al. | 362/18 |
| 5,951,139 | A | | 9/1999 | Smith et al. | |
| 6,113,252 | A | | 9/2000 | Arlitt et al. | |
| 6,203,174 | B1 | | 3/2001 | Plumeyer | |
| 6,241,366 | B1 | * | 6/2001 | Roman et al. | 362/293 |
| 6,464,373 | B1 | | 10/2002 | Petrick | |
| 6,837,603 | B2 | * | 1/2005 | Komarynsky | 362/526 |
| 6,846,101 | B2 | * | 1/2005 | Coushaine | 362/517 |
| 7,021,805 | B2 | * | 4/2006 | Amano et al. | 362/518 |
| 2006/0092638 | A1 | | 5/2006 | Harwood | |
| 2007/0268706 | A1 | * | 11/2007 | Wagener et al. | 362/348 |
| 2008/0316761 | A1 | * | 12/2008 | Minano et al. | 362/518 |

FOREIGN PATENT DOCUMENTS

| | | | |
|---|---|---|---|
| DE | 10252724 | A1 | 6/2003 |
| DE | 203 20 124 | U1 | 6/2005 |
| EP | 0584071 | B1 | 1/1999 |
| WO | 9627102 | A1 | 9/1996 |
| WO | 0136871 | A1 | 5/2001 |
| WO | 2006087126 | A1 | 8/2006 |

OTHER PUBLICATIONS

Can Cheng, The Patent Office of the P.R. China, Details of the First Office Action, date Apr. 6, 2010, 15 pages.

European Communication pursuant to Article 94(3) EPC for related Application No. 07 733 022.3-2423.

International Search Report corresponding to International Application No. PCT/US00/42247; dated Mar. 5, 2001 (1 page).

International Search Report corresponding to International Application No. PCT/EP2006/001101; dated May 2, 2006 (4 pages).

English Translation of Bibliographic data of Abstract for DE20320124U1 http://depatisnet.dpma.de/DepatisNet/... (2 pages).

Search Report corresponding to United Kingdon Application No. GB0510761.9 (1 page).

* cited by examiner

FIG. 19
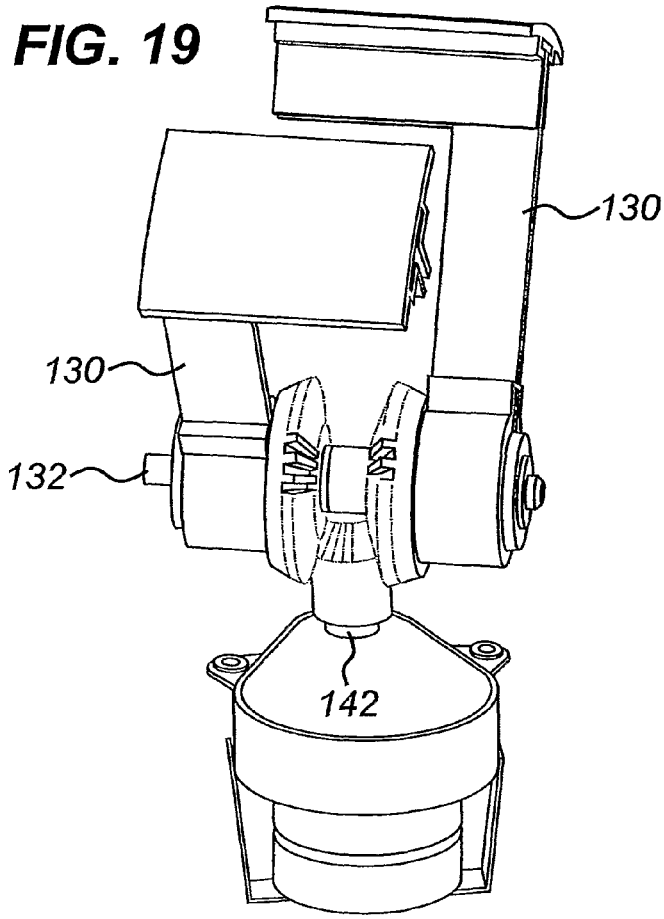
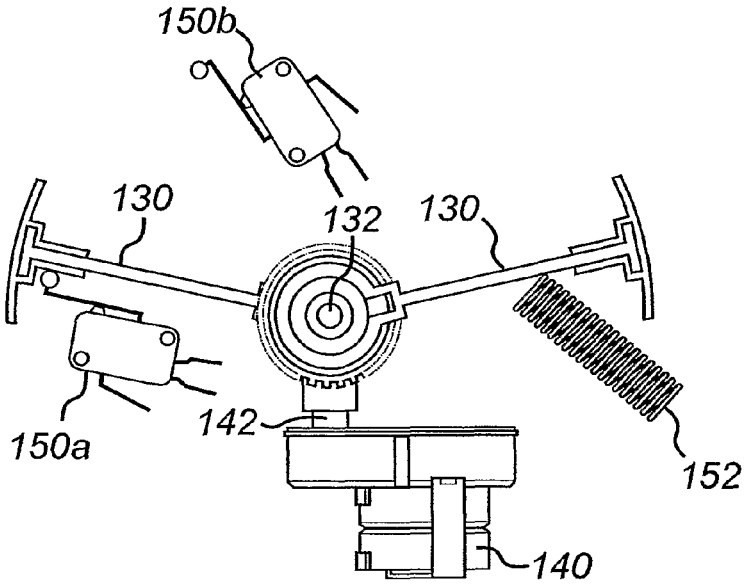
FIG. 20

LIGHTING SYSTEM WITH REFLECTOR THAT MOVES IN A PERIODIC MANNER

BACKGROUND OF THE INVENTION

1. Technical Field

The present invention relates to lights.

There is a need to provide active lighting for the home. Active lighting is a type of light fitting which alters the lighting of a room, preferably slowly over time, preferably even barely perceptibly. This type of lighting may be capable of creating a particular ambience and is desirable to a consumer wishing to highlight the modern design of their home.

2. Description of Related Art

It is known for light fittings to be connected to motors and servos to allow control of the direction, brightness, diffusion, colour, and nature of the beam produced by a bulb. However, this technology has been used almost exclusively in the world of stage lighting and night-clubs and, as a consequence, has been designed with requirements in mind that are considerably different to the requirements of a modern home owner wishing to decorate their home with innovative lighting styles.

Torches with variable beam angles are also well known. For example, Maglites™ produce a beam with a variable angle by positioning a light source within a parabolic reflector. The position of the parabolic reflector is movable relative to the light source along the axis of the parabola. Unless the light source is positioned at the focus of the parabola, the resulting beam emanating from the parabola is donut shaped. Consequently, a Maglite™ torch will not produce a variable size circular beam of light.

What is required is a simple and preferably automated way to periodically change the angle of a light beam over time, creating a transient lighting effect. This would preferably be achieved without complex controlling mechanisms and/or programming.

SUMMARY OF THE INVENTION

The present invention provides a lighting system. The lighting system comprises: a light source; a deflector positioned within the path of a beam of light emitted by the light source; and a reflector. At least one of the reflector and the deflector is moveable relative to the other of the reflector and the deflector.

By moving at least one of the reflector and the deflector relative to the other of the reflector and the deflector, the beam angle can be changed. Preferably, the range of beam angle that can be produced is from 8° to 60°. Alternatively, the range of beam angle that can be produced is preferably from 60° to 150°. The lighting system can be provided with two changeable alternative reflectors. Preferably, one of the reflectors is capable of producing a beam angle ranging from 8° to 60° and the other of the reflectors is capable of producing a beam angle ranging from 60° to 150°.

The lighting system of the present invention is significantly more efficient than prior art systems because a larger proportion of the light is reflected out of the system in the desired direction. The light is substantially evenly spread over the area of the light beam rather than over a donut-shape and the amount of light escaping from the system without being reflected by the reflector is minimised.

The reflector is preferably formed from a plurality of rings of reflective facets, each formed from the surface of a paraboloid. Preferably, each facet is formed from a paraboloid having a different focal distance. Thus, each facet produces a beam of light with a different beam angle. The focal distance of the rings preferably decreases with distance from the light source. i.e. the focal distance of the ring closest to the light source is larger than the focal distance of the ring furthest from the light source. Thus, the beam angle preferably increases with distance from the light source. The foci of the plurality of rings may be spaced along a central axis of the reflector. The reflector may include any number of rings. In a preferred embodiment, the reflector includes 10 rings.

Preferably the reflector is moveable relative to the deflector. Preferably the lighting system further comprises drive means for moving the reflector in a periodic motion relative to the deflector. More preferably the drive means comprises a cam in communication with the reflector for moving the reflector in a periodic motion relative to the deflector as the cam is rotated. The cam may comprise an off-centre circular cam having circular front and back faces. The cam is preferably driven by a motor.

In use, the cam may be positioned so that its circular front face is positioned vertically and parallel to a light housing on which the cam is mounted. The drive shaft of the motor may be connected to the back face of the cam in an off-center position. The drive shaft extends perpendicularly from a motor plate of the motor. Slack within the motor and motor shaft may cause the cam to run at an angle off-vertical. Consequently, to ensure the cam runs vertically and thus parallel to the housing surface to which it is attached, the motor plate may be mounted at an angle of 1 degrees back from the vertical.

The deflector is preferably cone-shaped, and more preferably regular cone-shaped. The apex of the deflector cone preferably faces the light source. Preferably, the axis of the deflector cone coincides with the axis of the reflector. The axis of the deflector cone may be movable relative to the axis of the reflector to change the direction and shape of the beam emitted from the light. The deflector cone may be injection-moulded with a plurality of support ribs or webs for mounting the deflector cone in the path of the light source.

The lighting system may further be provided with a diffusor. Preferably the diffusor comprises an opal glass disc. Preferably the glass has a 60% opal clarity. The diffusor may be mounted on the deflector cone.

Any type of light source can be used with the lighting system of the present invention. Examples of a suitable light source may include a normal incandescent bulb, a halogen bulb, and a light emitting diode.

Light and heat generated by the light source may be focussed onto the deflector by a parabolic reflector. This may create a localised hot spot on the deflector which could cause the deflector to melt.

In order to solve this problem, the surface of the deflector closest to the light source may be coated in aluminium. The aluminium may have a thickness of 1.2 mm. In a preferred embodiment, the deflector comprises a high-temperature polycarbonate (PC) deflector cone having an aluminium shield attached to the outside surface of the cone. The shield dissipates heat from the light source through convection and lowers the localised temperature of the deflector to ensure the deflector cone does not melt. In addition, both the PC deflector and the aluminium shield may further be coated in a layer of aluminium. The aluminium layer may have a thickness of between 0.003 and 0.005 mm.

Alternatively, the deflector may be made from a thermally stable plastic such as polyphenylene sulfide (PPS). The PPS deflector may further be coated in an aluminium layer. The aluminium layer may have a thickness of between 0003 and 0.005 mm.

To dissipate heat output from the light source and to prevent the lighting system from overheating, the lighting system may be provided with a ventilation pathway that allows cool air to be drawn through the interior of the lighting system. Preferably, the lighting system includes a housing to which the other components of the system are connected. The ventilation pathway may be provided by forming one or more vents in the components of the system to allow air to be drawn through the system.

Another embodiment of the invention comprises a lighting system comprising: a housing; a light source mounted within the housing; and at least one shutter, the or each shutter being mounted on an arm which is rotatably connected to a drive mechanism.

Preferably the lighting system includes two shutters. Preferably each shutter is mounted on a separate arm, and each arm is rotatably connected to the housing.

By rotating the or each arm, the or each shutter moves relative to the light source and acts to block light emitted from the light source so that the angle of the emitted beam can be varied.

The drive mechanism preferably includes a motor for driving the at least one arm. Preferably a single motor drives two arms. Preferably the motor drives the arms in a cyclic motion so that the or each shutter moves in a back-and-forth motion between a first position and a second position. Preferably the motor drives the arms in opposite directions simultaneously.

Preferably the housing includes an aperture through which light from the light source can be emitted.

Preferably the or each shutter can be moved across the aperture in the beam of light being emitted from the light source so that the angle of the beam of light emitted from the lighting system continuously increases and decreases. Preferably the beam of light emitted from the lighting system when the shutters are in the first position comprises a narrow strip of light. Preferably the beam of light emitted from the lighting system when the shutters are in the second position comprises a 120 degree segment of light.

The light source may be positioned within a reflector which directs the light emitted from the light source out of the housing of the lighting system.

Preferably the drive mechanism is mounted in the housing.

In one embodiment the drive mechanism comprises a set of bevelled gears. In particular, a first bevelled gear is connected to a drive shaft of a bi-directional motor and another bevelled gear is attached to each of the at least one arms. Preferably the lighting system includes two arms rotatably mounted about an axis and positioned on opposite sides of the first bevelled gear such that rotation of the drive shaft of the motor causes the bevelled gears attached to each arm to rotate in opposite directions and consequently causes the arms to move in unison in opposite directions.

The lighting system may further comprise first and second switches for changing the direction of the motor. The switches may be actuable by at least one of the arms. The switches may comprise microswitches.

In use, the arms start in a first position. The motor is switched on and the motor causes the arms to rotate in opposite directions to a second position. When the arms reach the second position, the first switch is actuated and the direction of the motor is reversed. Consequently, the direction of motion of the arms is reversed and the arms move from the second position towards the first position. When the arms reach the first position, the second switch is actuated and the direction of the motor is reversed again. The cyclic motion then starts again.

In addition, a spring may be positioned between one of the arms and the housing. The spring ensures a smooth movement of the shutters by keeping the shutters under constant tension and removing any backlash in the motor gearbox and the bevelled gears.

In another embodiment the drive mechanism comprises a magnetic drive mechanism. In particular, a ferritic plate is mounted on the end of each arm and each arm is rotatably mounted about an axis. A pair of magnets are connected to the drive shaft of a single-direction motor and positioned directly opposite each other relative to the axis of the drive shaft. The ferritic plates are positioned close to the magnets.

In use, the drive shaft of the motor is caused to rotate in a first direction. Rotation of the drive shaft causes the magnets to rotate about the axis of the drive shaft. The ferritic plates are attracted to the magnets and rotation of the magnets causes the ferritic plate at the end of each arm to move away from and towards the ferritic plate at the end of the other arm in a back-and-forth motion. Motion of the ferritic plates, in turn, causes the arms and shutters to move in a back-and-forth motion thus causing the angle of the light beam emitted from the lighting system to continuously increase and decrease.

In an alternative embodiment of the drive mechanism, the arms are connected to the motor via an arrangement of linkages. In particular, a disc is connected to the drive shaft of a single-direction motor. A first end of a first link is connected to the disc and a second end of the first link is connected to a sliding pivot. First ends of the second and third links are connected to the sliding pivot and second ends of the second and third links are connected to first and second arms. The arms are connected to one another and to the housing via a static pivot.

In use, rotation of the drive shaft of the motor causes the disc to rotate which in turn causes the first end of the first link to follow a circular path and the sliding pivot to move back-and-forth. Movement of the sliding pivot causes the first ends of the second and third linkages to move back-and-forth which causes the arms to rotate about the fixed pivot in a back-and-forth motion. Rotation of the arms about the fixed pivot causes the shutters to move in a back-and-forth motion thus causing the angle of the light beam emitted from the lighting system to continuously increase and decrease.

With all embodiments of the drive mechanism, the motor can be left to run which causes the light beam emitted from the lighting system to continuously increase and decrease. Alternatively, the motor can be stopped at any stage thus causing the light beam emitted from the lighting system to be set at a particular angle.

The lighting systems of the present invention may be incorporated into any type of lighting apparatus, for example: a table lamp, a floor standing lamp, a wall light, a ceiling light or any external lighting.

BRIEF DESCRIPTION OF THE DRAWING FIGURES

Embodiments of the present invention will now be described in detail by way of example with reference to the following figures in which:

FIG. 19 shows a perspective view of the detail of a part of the lighting system of FIG. 16.

FIG. 20 shows a front view of a part of the lighting system of FIG. 16.

DETAILED DESCRIPTION OF THE INVENTION

Figure 1:
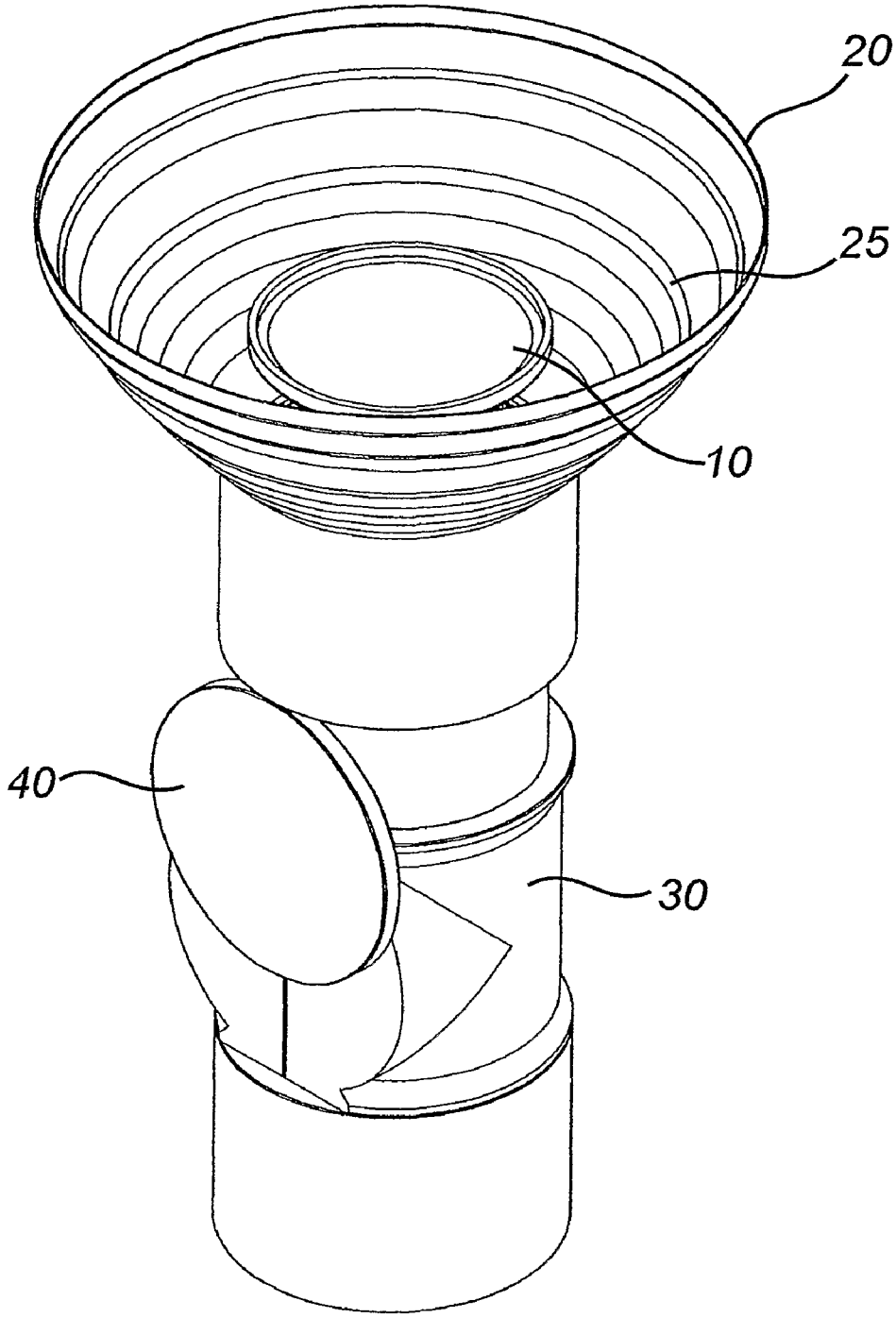
FIG. 1 shows a perspective view of a first embodiment of the invention.
Figure 2:
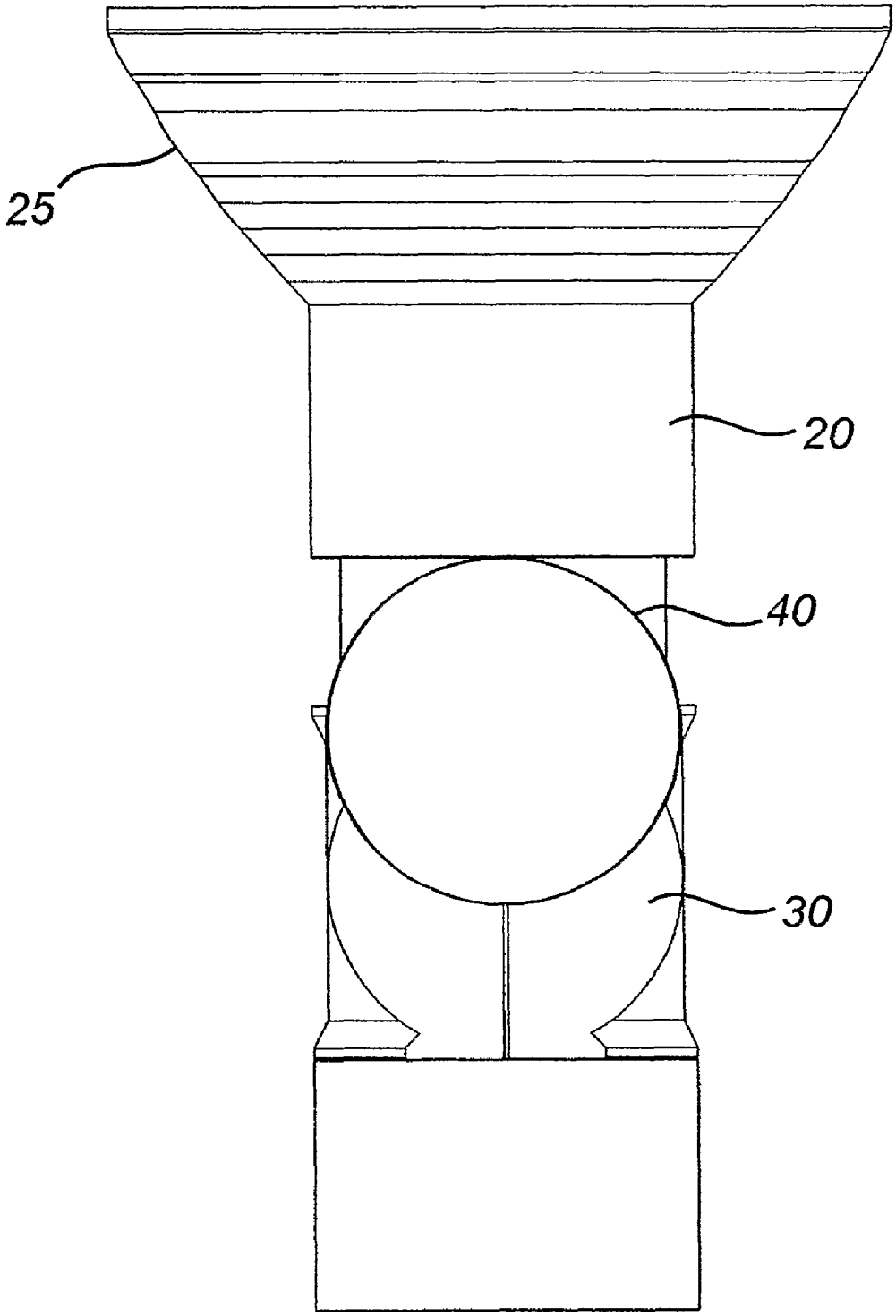
FIG. 2 shows a side view of the embodiment of FIG. 1.
Figure 3:
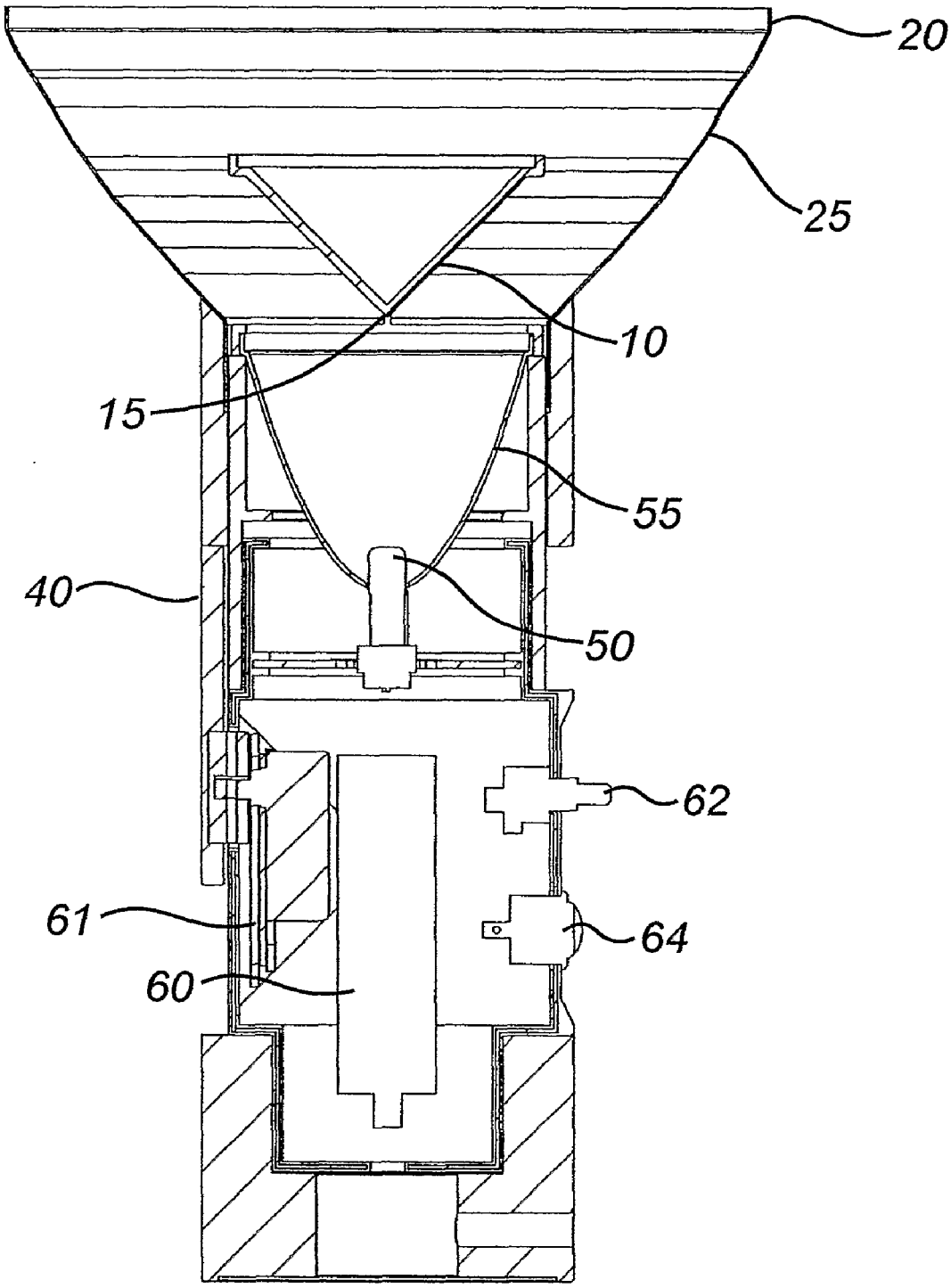
FIG. 3 shows a cross sectional side view of the embodiment of FIGS. 1 and 2.
Figure 4:
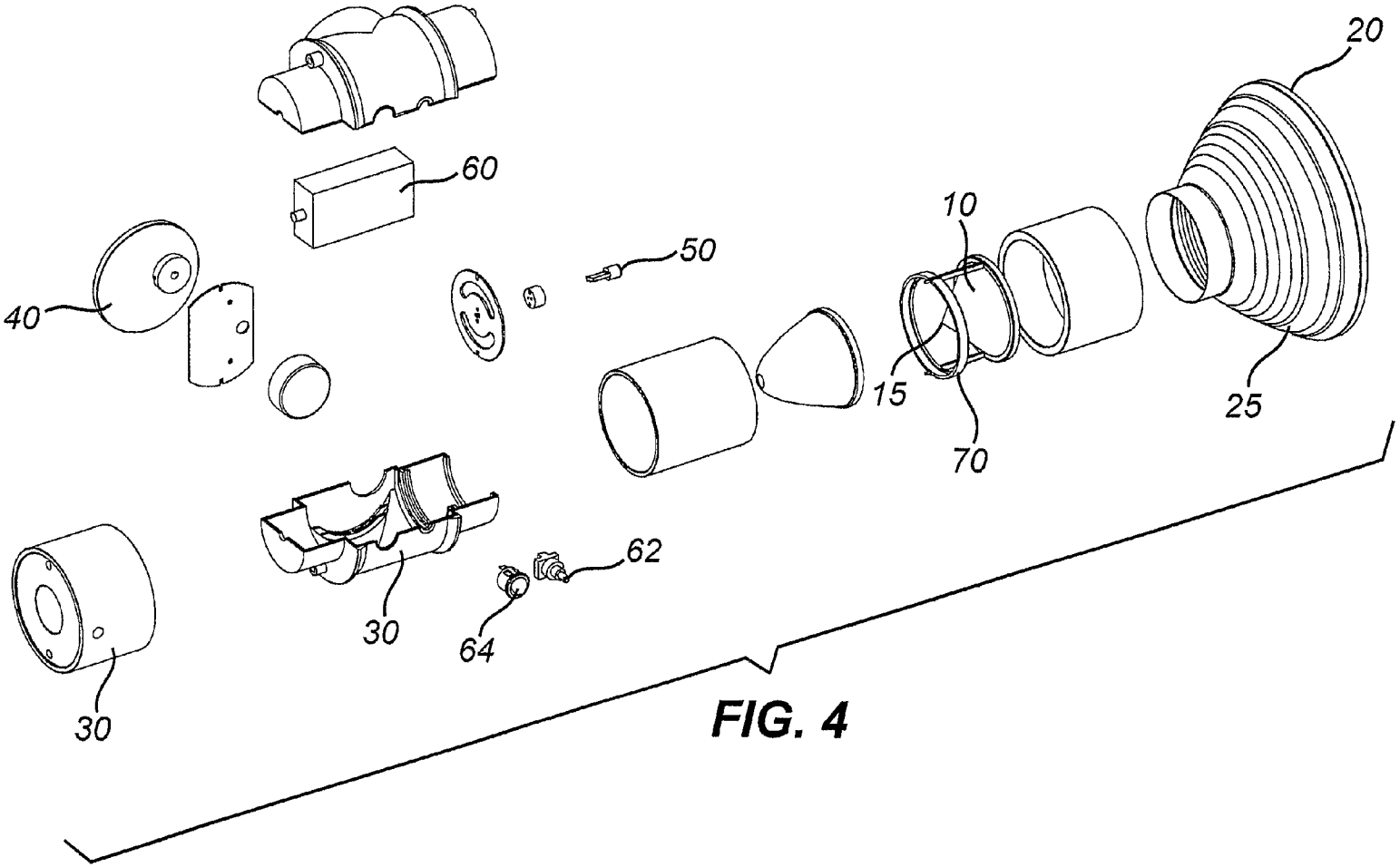
FIG. 4 shows an exploded view of the embodiment of FIGS. 1 to 3.
Figure 5:
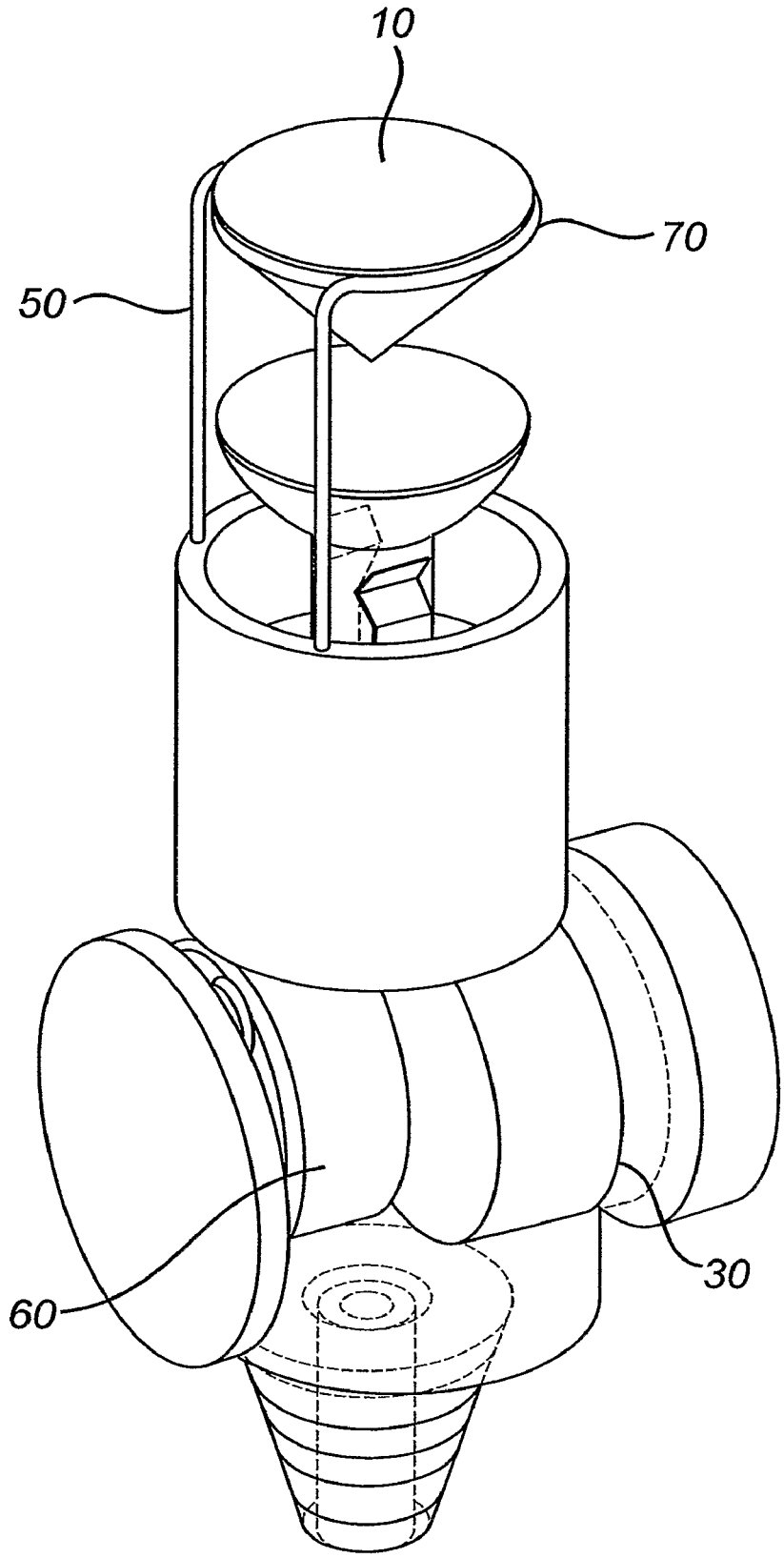
FIG. 5 shows a perspective view of the internal workings of an alternative embodiment of the present invention.
Figure 6:
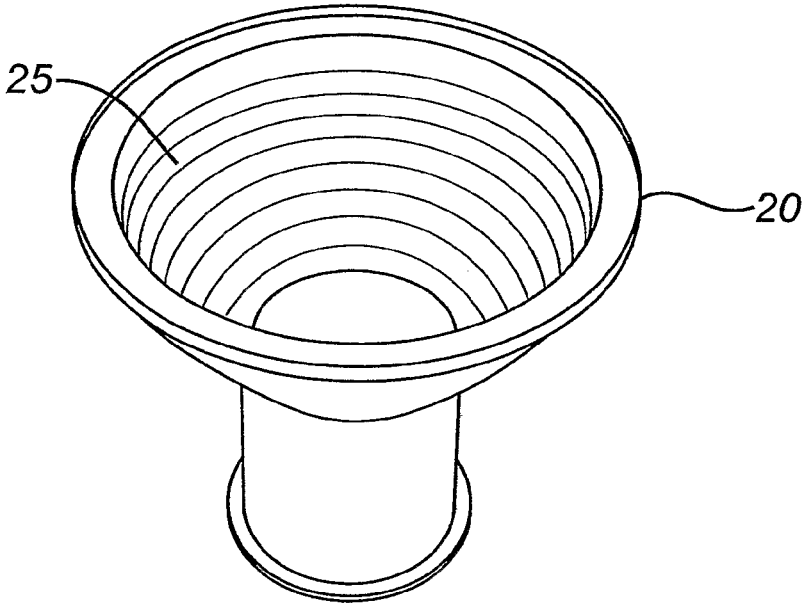
FIG. 6 shows a perspective view of the reflector of the embodiment of FIGS. 1 to 4.
Figure 7:
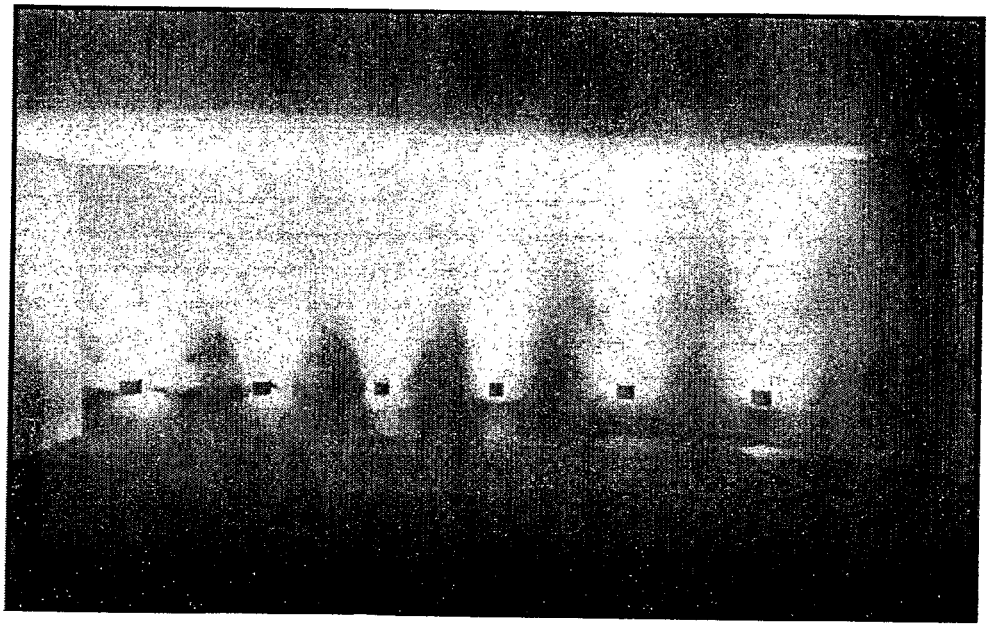
FIG. 7 shows the changing light beam emitted from the light of FIGS. 1 to 4 and 6.
Figure 8:
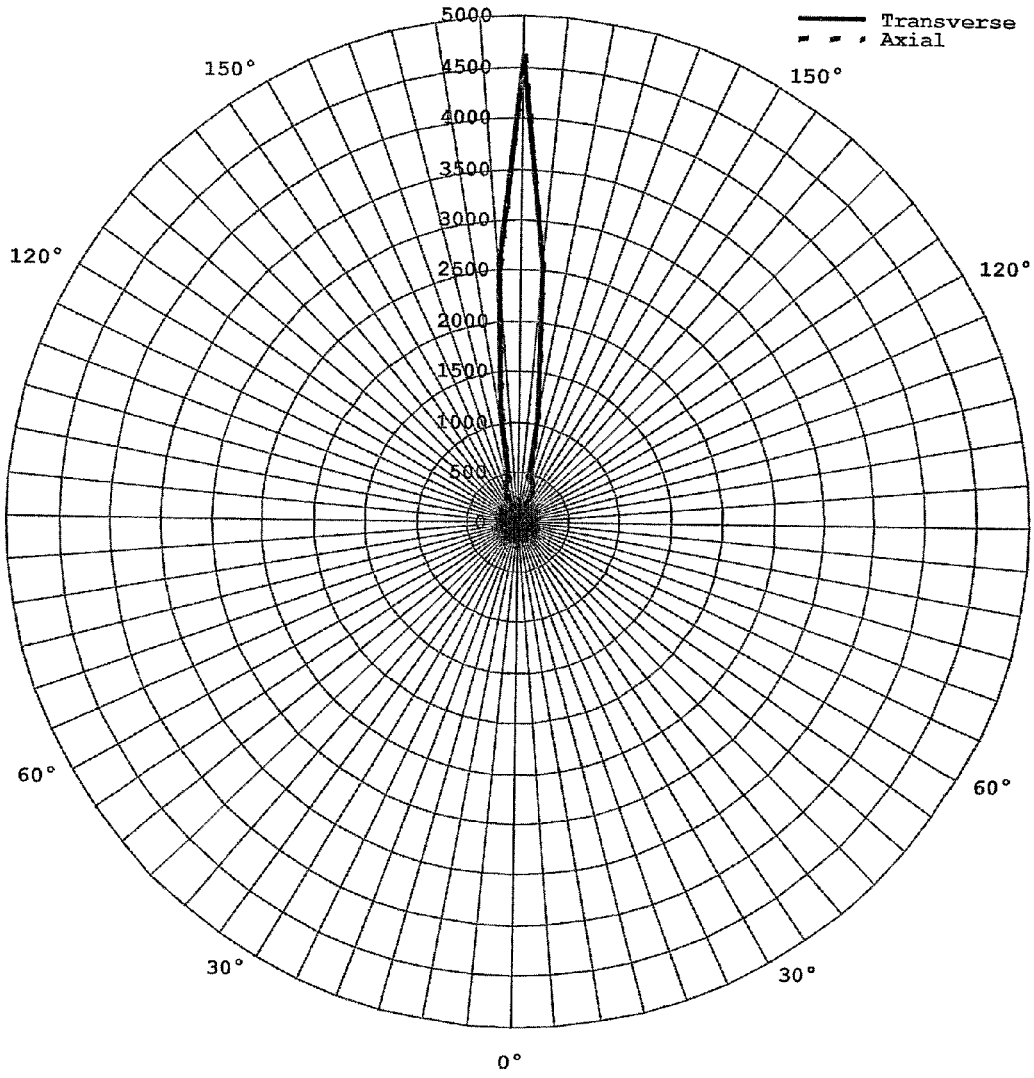
FIGS. 8 to 12 show polar curves of the intensity and angle at which light is distributed from the embodiment of FIGS. 1 to 4, 6 and 7.
Figure 9:
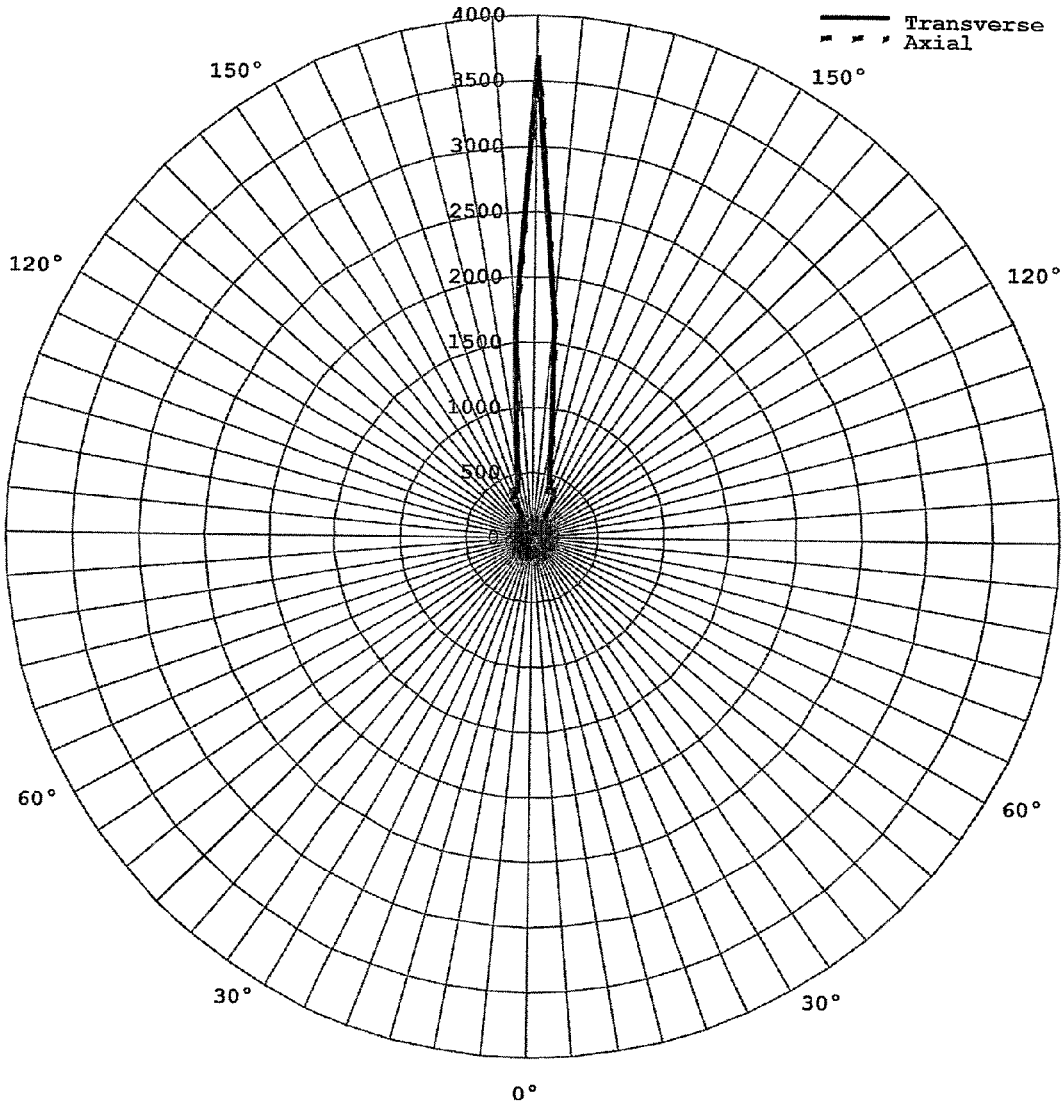
Figure 10:
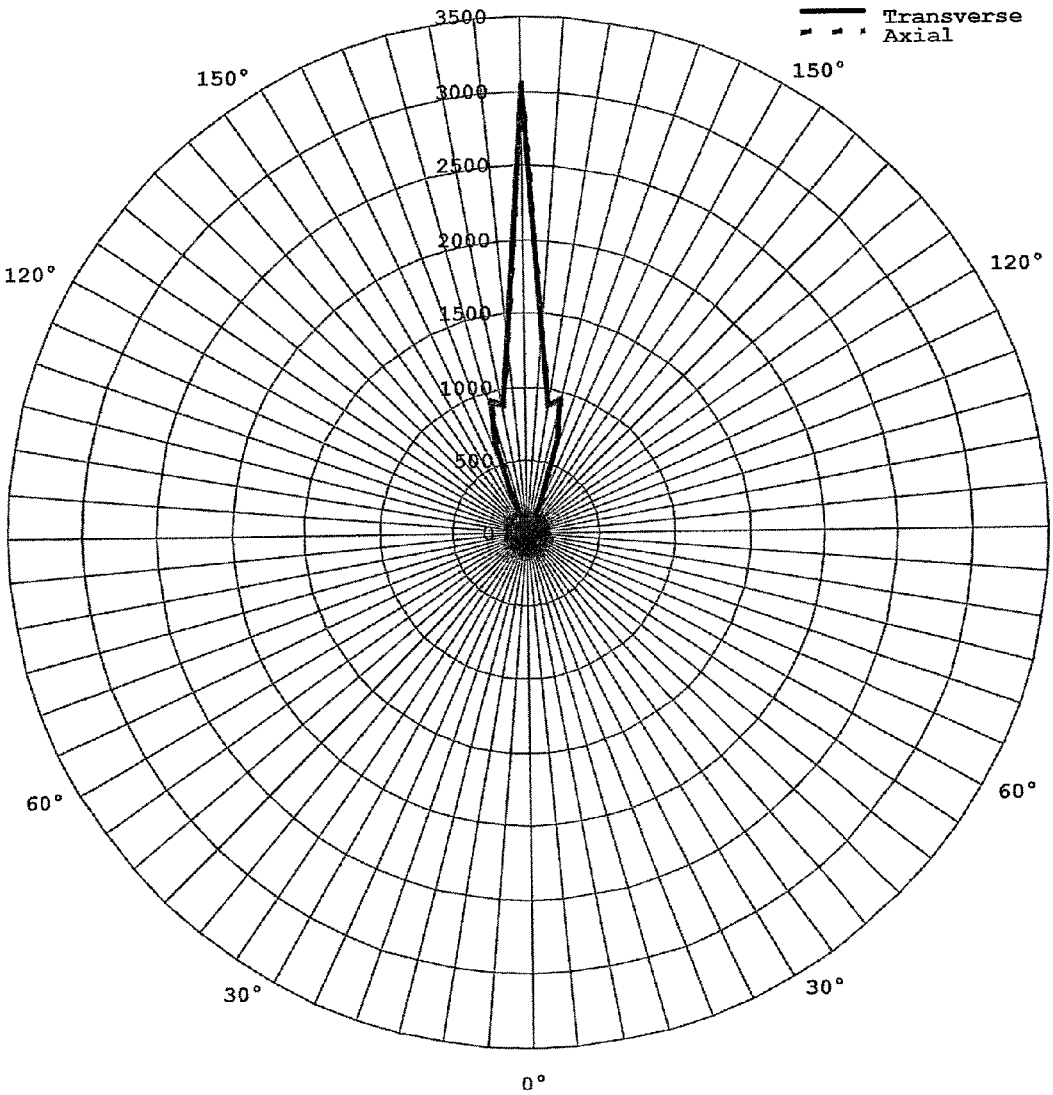
Figure 11:
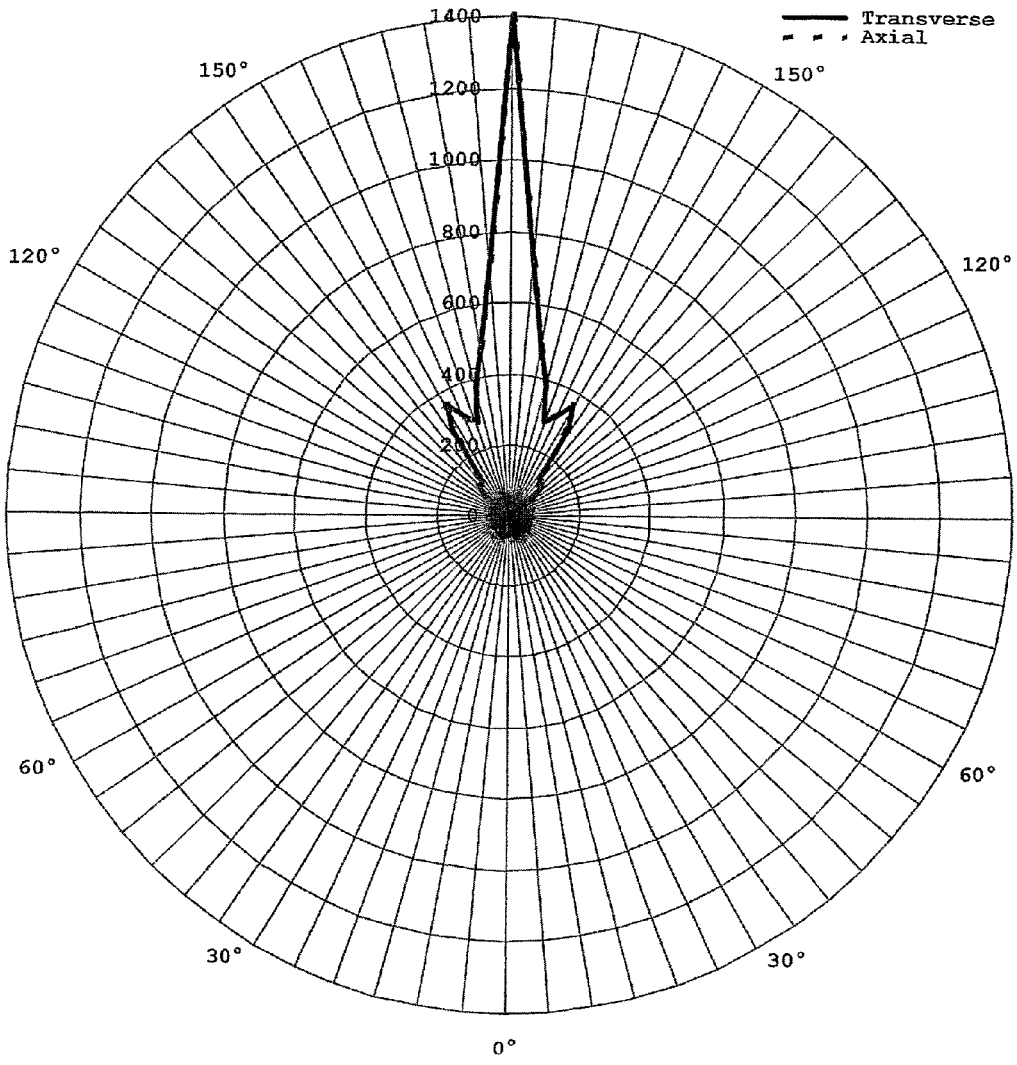
Figure 12:
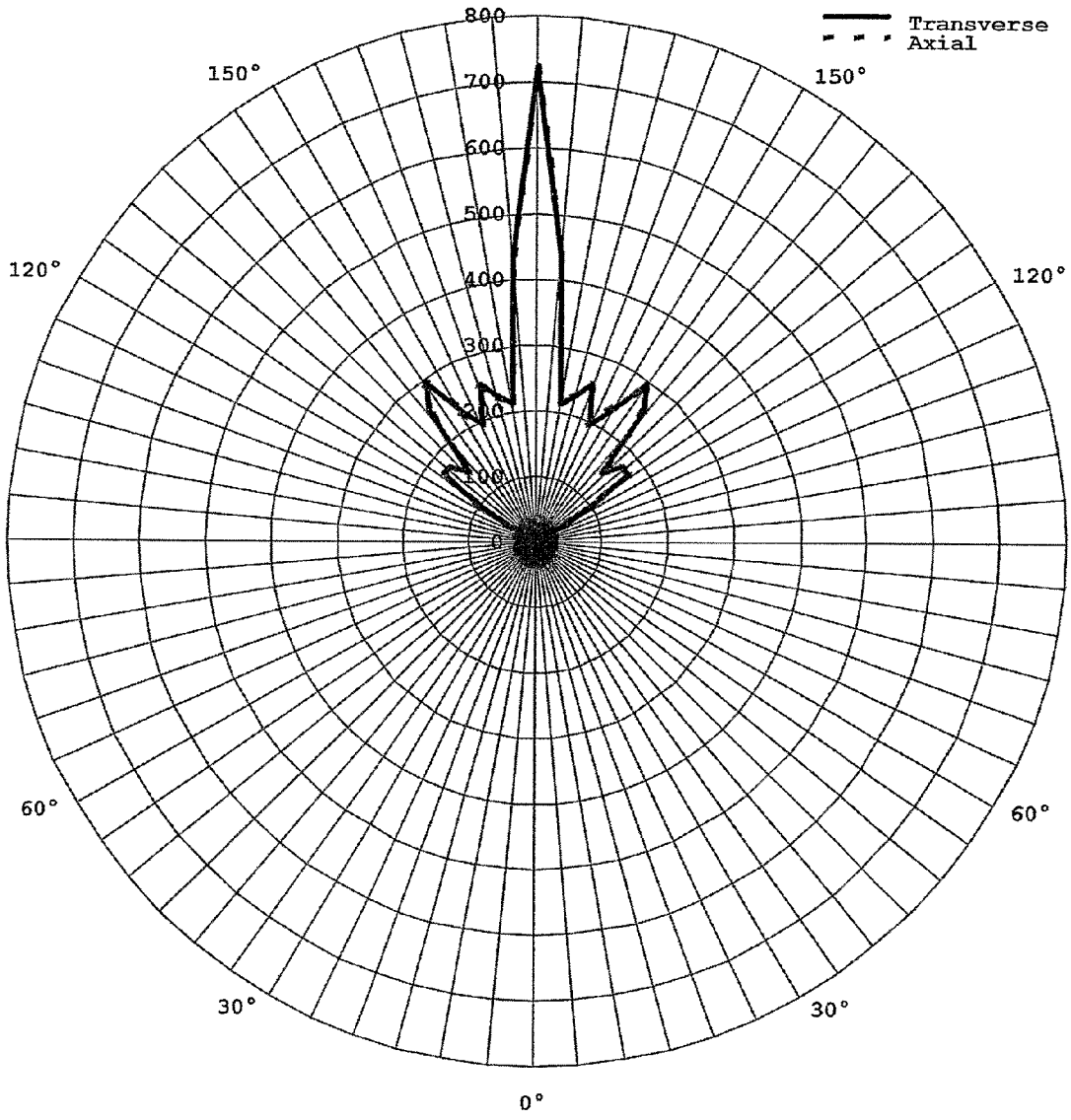

A light according to a first embodiment of the present invention is shown in FIGS. 1 to 4, 6 and 7. The light comprises a light source 50 mounted in a base unit 30. The light source comprises a 12V 100 W halogen capsule. The light source is mounted in a parabolic reflector 55. The embodiment shown in FIG. 5 is the same as that shown in FIGS. 1 to 4, 6 and 7, except that the light source 50 comprises a dichroic halogen bulb and no-parabolic reflector is present.

A cone shaped deflector 10 is positioned within the path of a light beam emitted by the light source 50. The conical surface of the deflector 10 is reflective. The surface of the deflector closest to the light source may be coated in aluminium. In a preferred embodiment, the deflector comprises a high-temperature polycarbonate (PC) deflector cone having an aluminium shield attached to the surface of the cone closest to the light source. Both the PC deflector and the aluminium shield may further be coated with another thinner layer of aluminium. Alternatively, the deflector may be made from a thermally stable plastic such as polyphenylene sulfide (PPS). The PPS deflector may further be coated in a thin aluminium layer.

Surrounding the cone-shaped deflector 10 is a reflector 20. The reflector 20 is bowl shaped and the inner surface of the reflector 20 is formed from a plurality of ring shaped facets 25. Each ring shaped facet 25 is formed from the surface of a paraboloid. Each ring shaped facet is formed from a paraboloid having a different focal distance. The focal distance of the rings decreases with distance from the light source. The reflector 20 is capable of being moved vertically relative to the base unit 30, light source 50 and deflector cone 10. The reflector 20 is positioned so as to rest upon an edge of an off-centre circular cam 40. The off-centre circular cam 40 is mounted on the base unit 30. The off-centre cam 40 may be driven by a motor 60 housed within the base unit 30.

The light source 50 shines a beam directly on to the cone shaped deflector 10. The beam is reflected by the deflector 10 into a ring of light, which travels outwards from the deflector 10. In the embodiments shown in FIGS. 1 to 7, the apex 15 and axis of the cone are pointing directly at the light source 50.

Light reflected by the deflector 10 strikes the inside surface of the reflector 20 which is formed from a plurality of ring shaped reflective facets 25. Light striking each facet 25 is reflected out of the top end of the reflector 20.

The light reflected by the deflector 10 strikes the reflective ring-shaped facets 25 on the inside of the reflector 20 at a specific vertical level relative to the deflector 10. Therefore, vertically moving the reflector 20 upward relative to the deflector 10 results in the light being reflected by the reflective ring facets 25 further down the reflector 20.

Because the focal distance of each ring-shaped facet is different, the angle at which light from the deflector is reflected by the ring facet will be different for each ring. In the embodiments shown in FIGS. 1 to 7, the focal distance decreases with distance from the light source. Therefore light emanating from the deflector which strikes the facets furthest from the light source produces a wider beam angle than light which strikes the facets closest to the light source. The focal distance of the parabolas forming the ring facets in between the top and the bottom of the reflector 20 gradually increases from the top to the bottom. In the embodiment shown, the reflector includes ten ring facets.

The base unit 30 includes a motor 60 and an off-centre cam 40. As the off-centre cam 40 rotates, the reflector 20 is pushed upward relative to the deflector 10 by the edge of the cam 40. As this occurs, the beam angle of the light emitted out of the reflector 20 is reduced. Furthermore, when the off-centre cam 40 rotates further and the reflector 20 moves downwards relative to the deflector 10, the beam angle of the light emitted out of the reflector 20 is increased. The cam leads to a cyclic motion such that the beam angle cycles between a maximum and a minimum.

The cam 40 is positioned so that its circular front face is positioned vertically and parallel to a side of the base unit 30. The motor 60 is mounted on the base unit 30 via a motor plate 61. To ensure the cam 40 runs vertically and thus parallel to the surface of the base unit 30 to which it is attached, the motor plate 61 is mounted at an angle of 1 degrees back from the vertical.

The base unit also includes a potentiometer 62 which acts as a dimmer switch, a transformer, and an on/off switch 64. Consequently, the lighting system can be plugged directly into the mains, without the need for a dimmer switch, an on/off switch or transformer on the power lead or a remote control.

FIGS. 8 to 12 are polar curves showing the intensity and angle at which light is distributed from the reflector of the lights shown in FIGS. 1 to 7. As can be seen, the angle of the beam increases from FIG. 8 through to FIG. 12, as the reflector moves downward relative to the deflector. As the angle increases, the same amount of light is spread over a larger angle, and dispersed evenly over the area of the beam.

In the embodiments shown in FIGS. 1 to 5, the cone shaped deflector 10 is mounted on the base unit 30 by means of a wire frame 70, which functions to maintain its the position of the deflector cone 10 in the path of the light beam. Part of the wire frame 70 encircles the base of the deflector cone 10 and another part of the wire frame 70 acts as legs to space the cone 10 from the light source. Both ends of the wire frame 70 are rooted in the base unit 30. The advantage of this arrangement is that the light reflected off the deflector cone 10 is relatively uninterrupted (except for two wire-thin lines, which become irrelevant when the light is reflected by the reflector 20).

Figure 13:
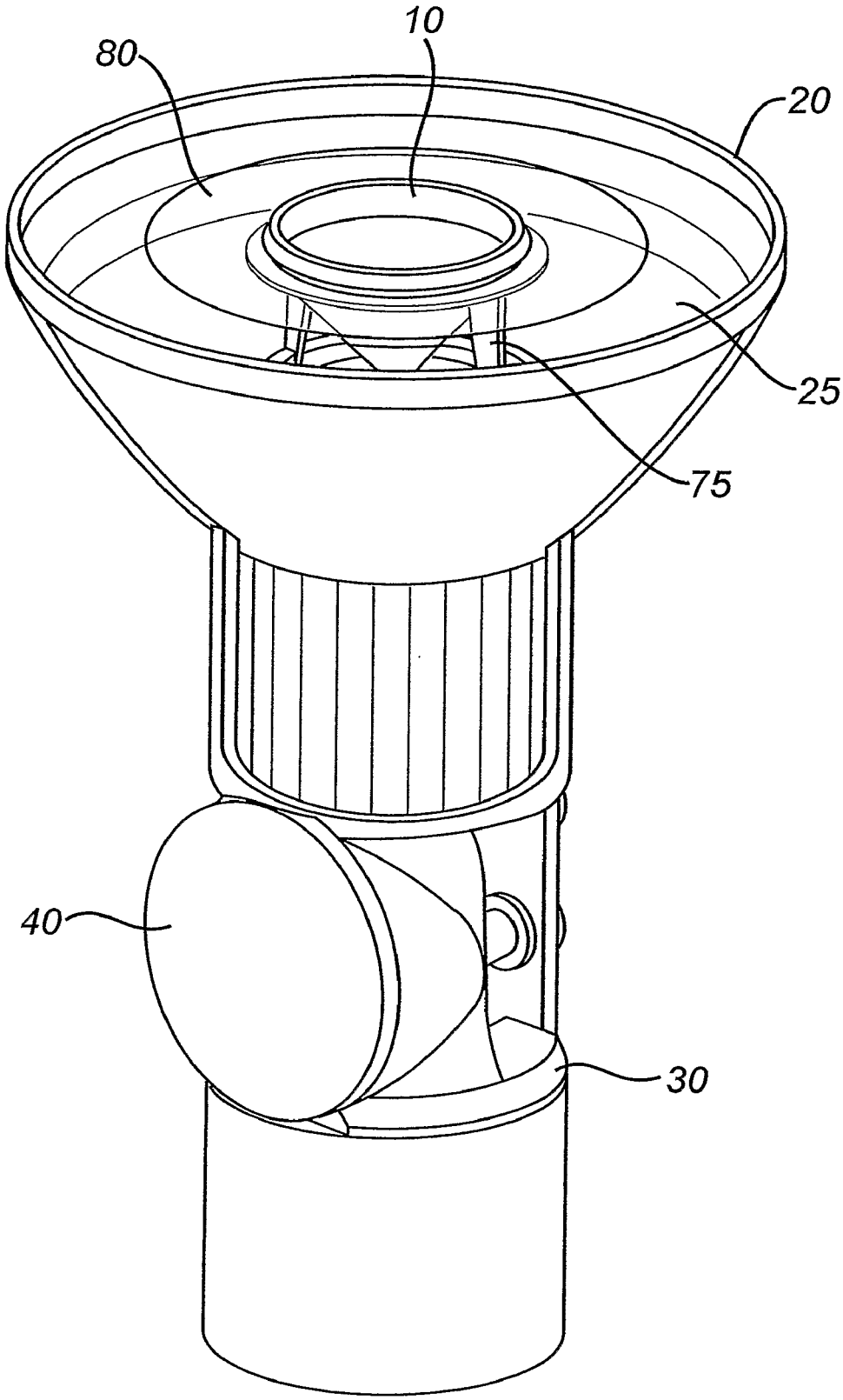
FIG. 13 shows a perspective view of an alternative embodiment of the present invention.
Figure 14:
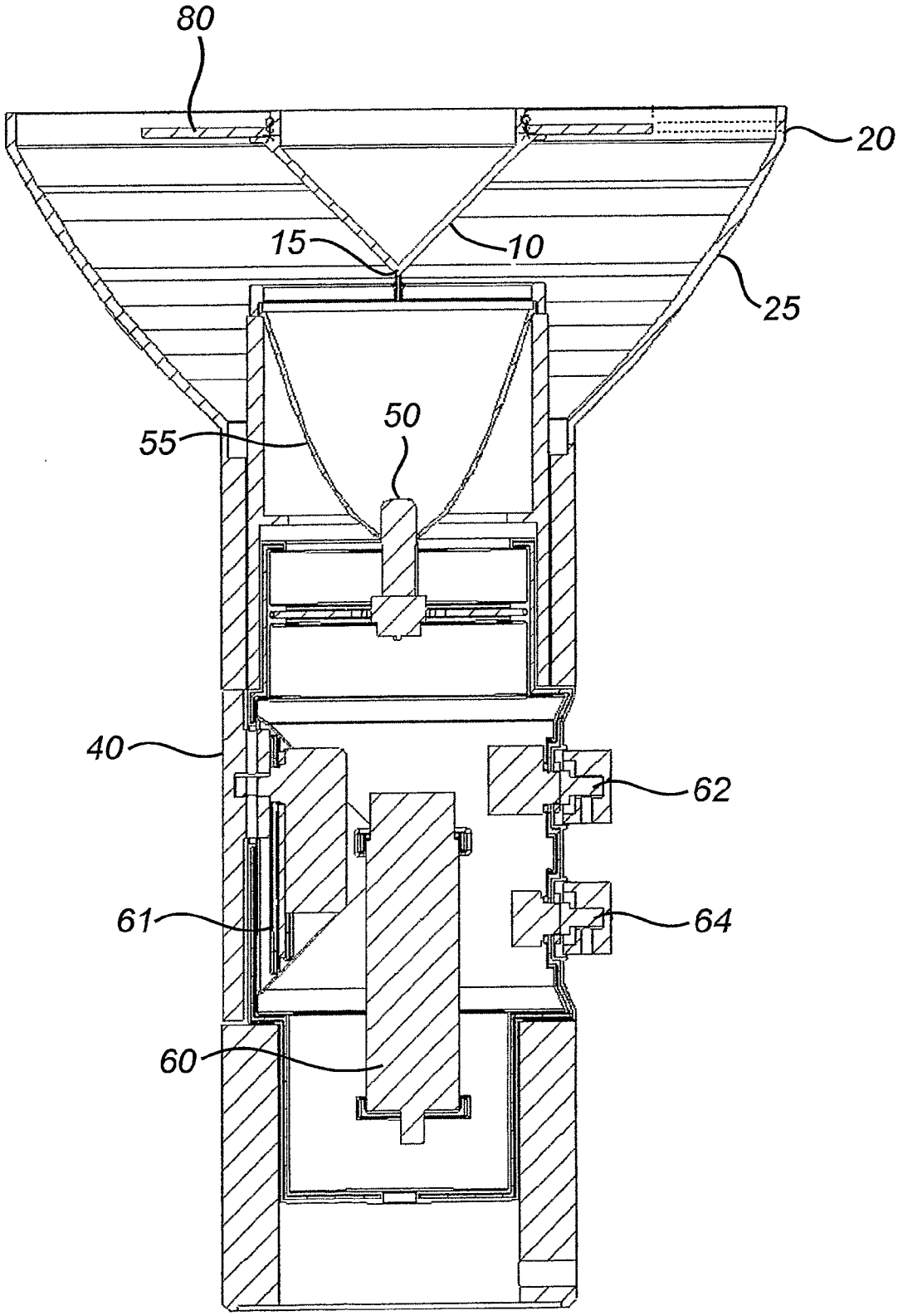
FIG. 14 shows a cross sectional side view of the embodiment of FIG. 13.
Figure 15:
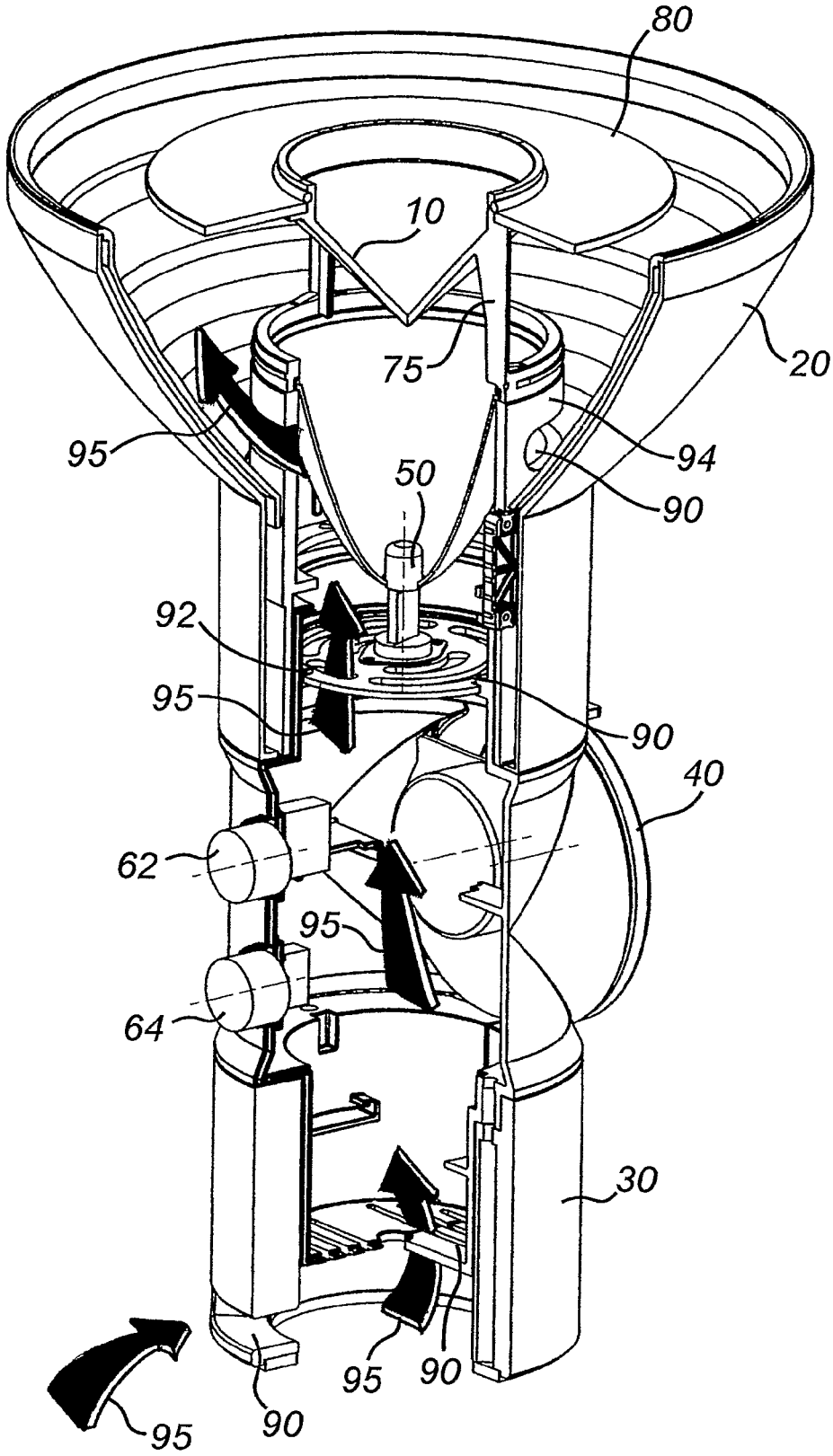
FIG. 15 shows a perspective view of an alternative embodiment of the present invention.

Alternatively, in the embodiment shown in FIGS. 13, 14 and 15, the cone shaped deflector 10 is injection-moulded with ribs or webs 75 for mounting the deflector on the base unit 30. The ribs or webs 75 function to maintain the position of the deflector cone 10 in the path of the light beam. The ribs or webs 75 act to space the cone 10 from the light source. Again, the advantage of this arrangement is that the light reflected off the deflector cone 10 is relatively uninterrupted (except for two thin lines, which become irrelevant when the light is reflected by the reflector 20).

The embodiment shown in FIGS. 13, 14 and 15 also includes a diffusor disc 80 formed from opal glass which is present to diffuse the light emitted from the lighting system in order to reduce side spill and give a more uniform distribution of light. The opal glass shown has an opal clarity of 60%.

As can be seen in FIG. 15, in order to dissipate heat output from the light source and to prevent the lighting system from overheating, the lighting system may be provided with a ventilation pathway 95 that allows cool air to be drawn through the interior of the lighting system. The ventilation pathway is provided by machining or tooling vents 90 in various components of the system to allow air to be drawn through the system. In particular, vent 90 are formed in the base unit 30, and in the interior structure of the lighting system including in a bulb plate 92 and a guide tube 94.

Figure 16:
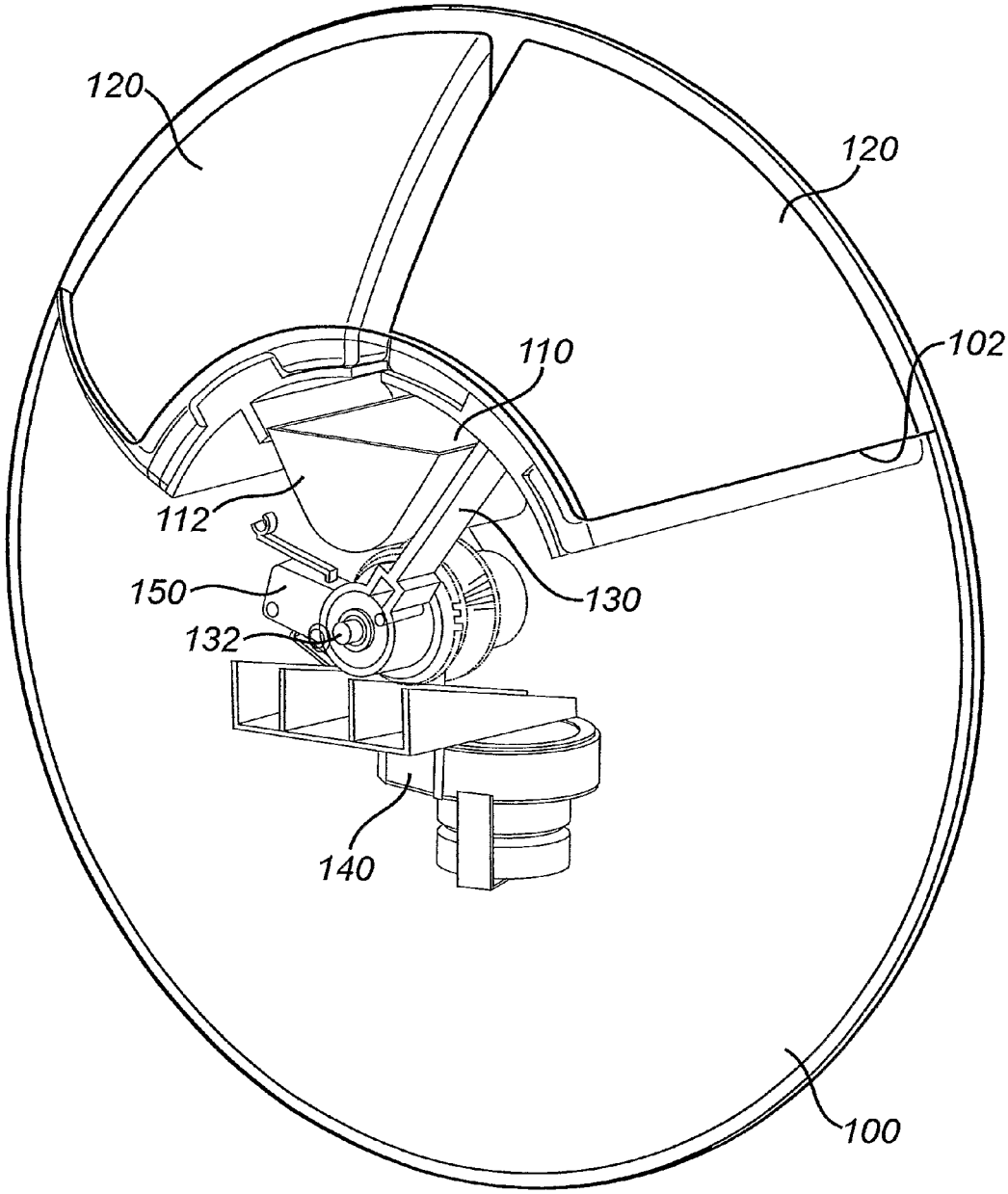
FIG. 16 shows a perspective view of an alternative lighting system according to the present invention with a part of the system shown as transparent.

An alternative lighting system is shown in FIG. 16. The lighting system comprises a housing 100 having an aperture 102, a light source 110 mounted within a reflector 112 in the housing 100, and a pair of shutters 120. Each shutter 120 is mounted on the end of an arm 130. The arms 130 are rotatably mounted about an axis 132 which is connected to the housing 100. A motor 140 is mounted within the housing.

As can be seen best from FIG. 19, the motor has a drive shaft 142. A small bevelled gear 144 is connected to the drive shaft and a pair of larger bevelled gears 146 are mounted on the axis 132 in communication with the arm 130. The bevelled gears 144, 146 are arranged so that the small bevelled gear 144 meshes with both of the large bevelled gears 146. A pair of microswitches 150 are mounted within the housing. A spring 152 is connected to one of the arms 130 and to the housing 100.

Figure 17:
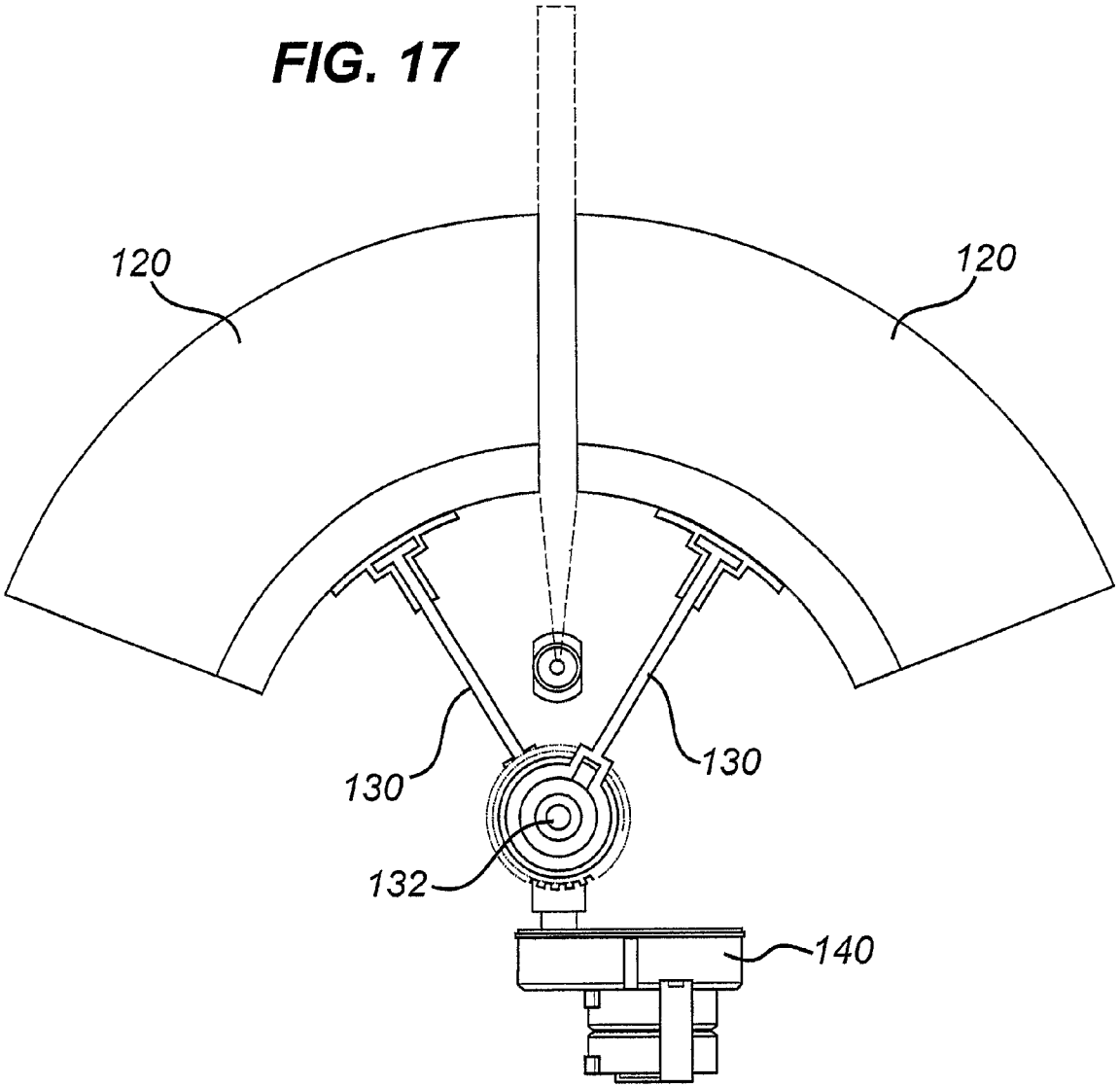
FIG. 17 shows a front view of a part of the lighting system of FIG. 16 in a first position.
Figure 18:
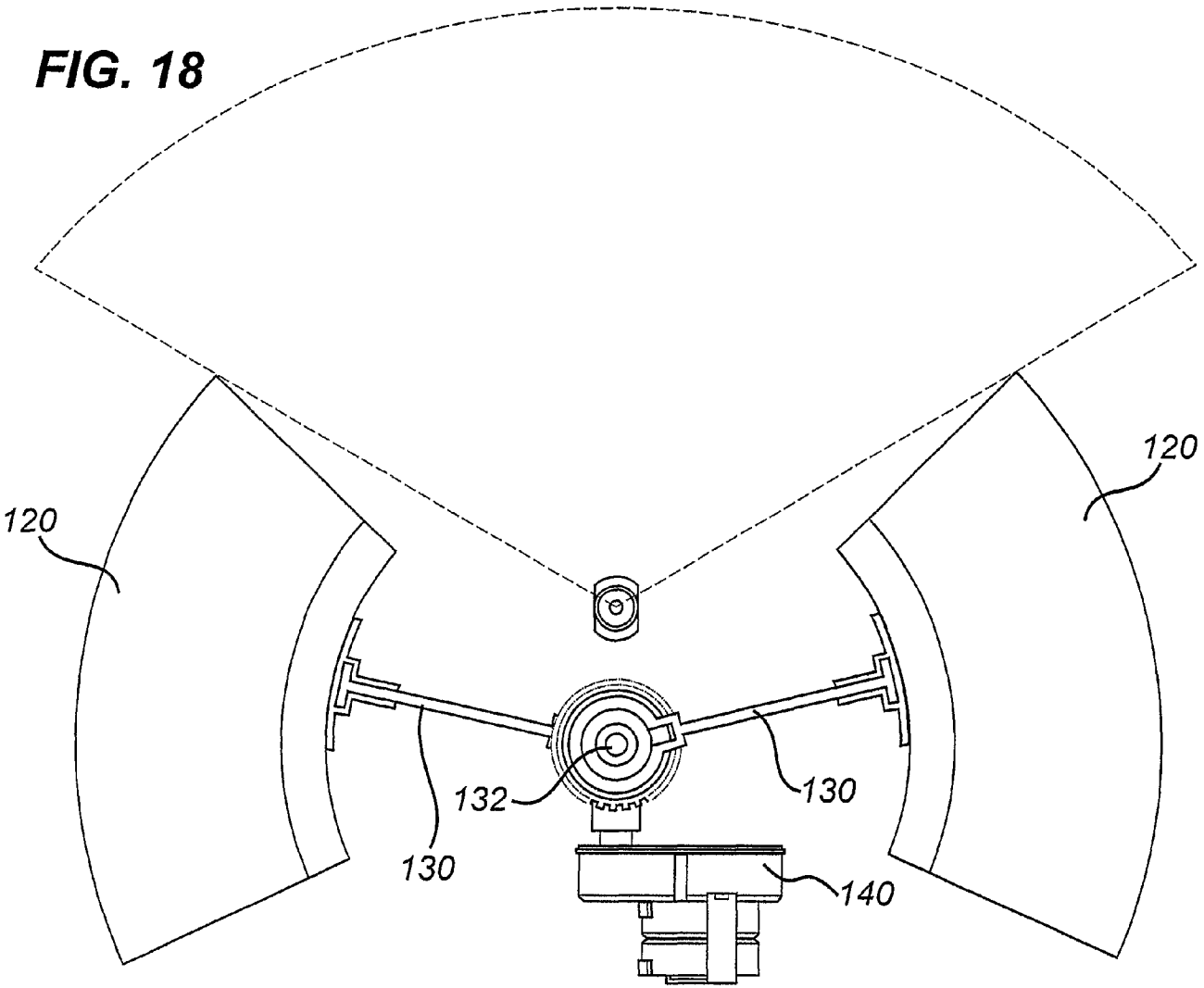
FIG. 18 shows a front view of the part of the lighting system shown in FIG. 17 in a second position.

In use, the arms 130 start in a first position shown in FIGS. 16 and 17. The shutters 120 are positioned within the aperture 102 of the housing 100 so that a narrow strip of light is emitted from the lighting system (see FIG. 17). The motor is switched on, thus causing the bevelled gears 144, 146 to rotate and the arms 130 to rotate in opposite directions about the axis 132, from the position shown in FIG. 17 to the position shown in FIG. 18. Consequently, the shutters are moved into the housing, away from the aperture 102, and light is emitted from the lighting system in a broad segment (see FIG. 18).

When the arms reach the second position, one of the arms 130 strikes one of the microswitches 150*a* as shown in FIG. 20. The first switch 150*a* is actuated, thus causing the direction of the motor 140 to be reversed. Consequently, the direction of motion of the arms is reversed and the arms move from the position shown in FIG. 18 back towards the position shown in FIG. 17. The angle of the beam of light emitted from the lighting system thus decreases. When the arms reach the position shown in FIG. 17, the second switch 150*b* is actuated and the direction of the motor 140 is reversed again. The cyclic motion then starts again. The spring 152 links one of the arms 130 to the housing 100 thus keeping the shutters 120 under constant tension and ensuring a smooth movement of the shutters 120.

Accordingly, the shutters 120 move back-and-forth across the aperture 102 in the housing so that the angle of the beam of light emitted from the lighting system continuously increases and decreases.

Figure 21:
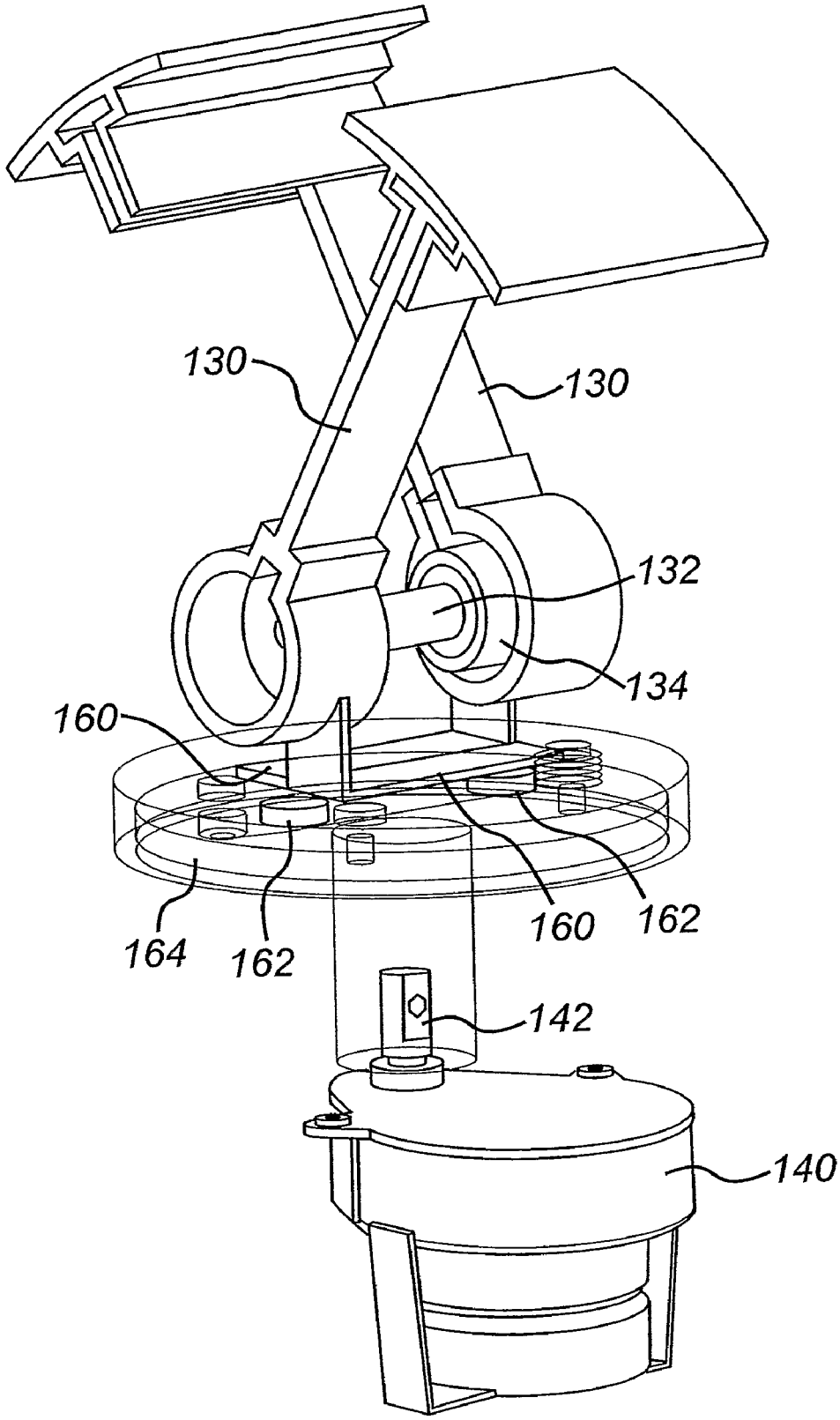
FIG. 21 shows a perspective view of an alternative drive mechanism for the lighting system of FIG. 16 in a first position.
Figure 22:
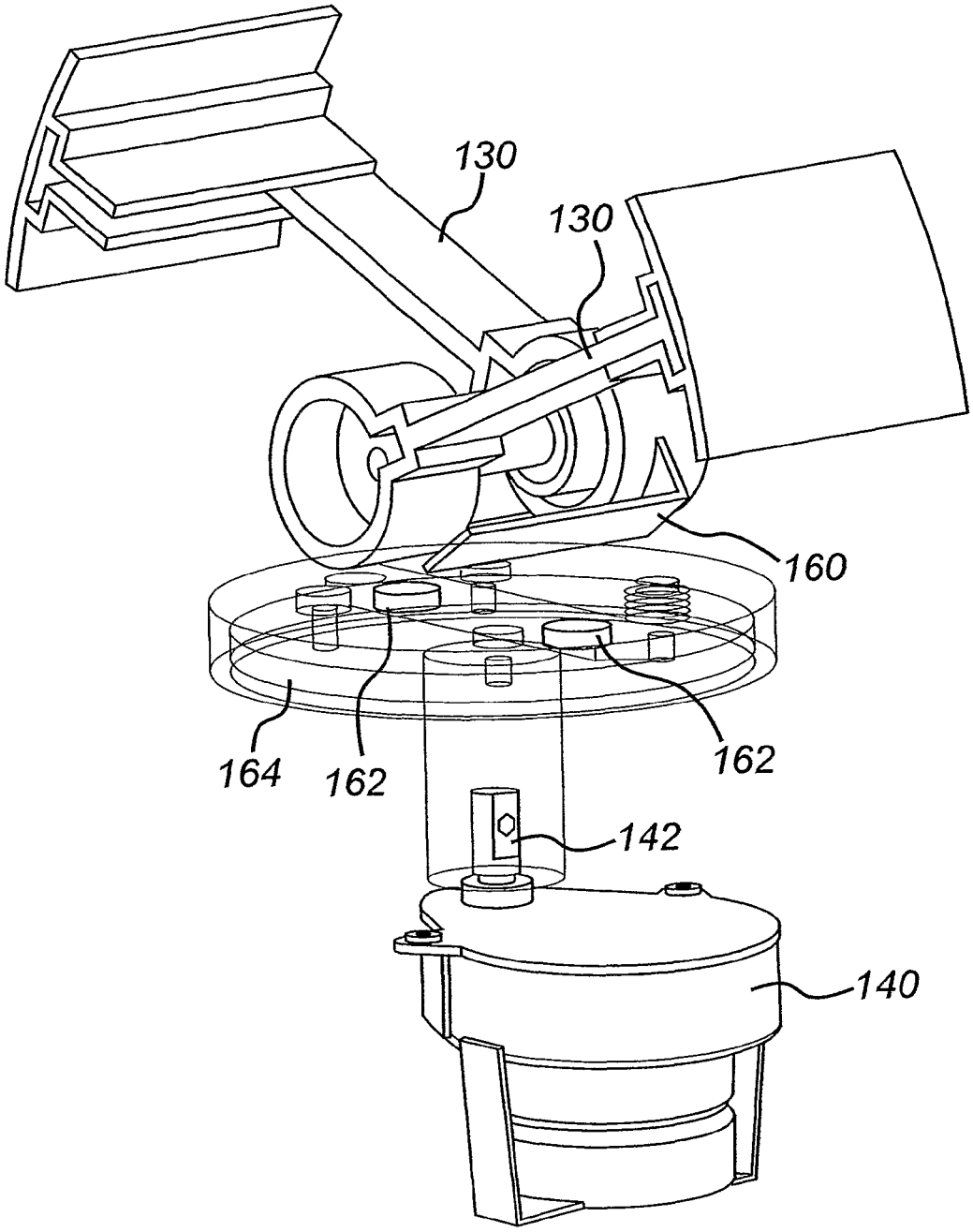
FIG. 22 shows a perspective view of the drive mechanism of FIG. 22 in a second position.

An alternative drive mechanism for the lighting system of FIG. 16 is shown in FIGS. 21 and 22. The drive mechanism comprises a magnetic drive mechanism. In particular, a ferritic plate 160 is mounted on the end of each arm 130 and each arm 130 is rotatably mounted about the axis 132 via a bearing 134. A non-ferritic disc 164 containing two magnets 162 directly opposite the axis from one another is connected to the drive shaft 142 of a motor 140. The ferritic plates 160 are positioned so that there is a small gap between the plates 160 and the disc 164.

In use, the arms 130 start in a first position shown in FIGS. 16 and 17. The shutters 120 are positioned within the aperture 102 of the housing 100 so that a narrow strip of light is emitted from the lighting system (see FIG. 17). The motor is switched on, so that the drive shaft 142 of the motor 140 rotates in a first direction. Rotation of the drive shaft 142 causes the magnets 162 to rotate about the drive shaft 142. The ferritic plates are attracted to the magnets and consequently follow the magnets so that rotation of the magnets 162 causes the ferritic plate 160 at the end of each arm 130 to move away from and towards each other in a back-and-forth motion. Motion of the ferritic plates, in turn, cause the arms and shutters to move in a back-and-forth motion thus causing the angle of the light beam emitted from the lighting system to continuously increase and decrease.

Figure 23:
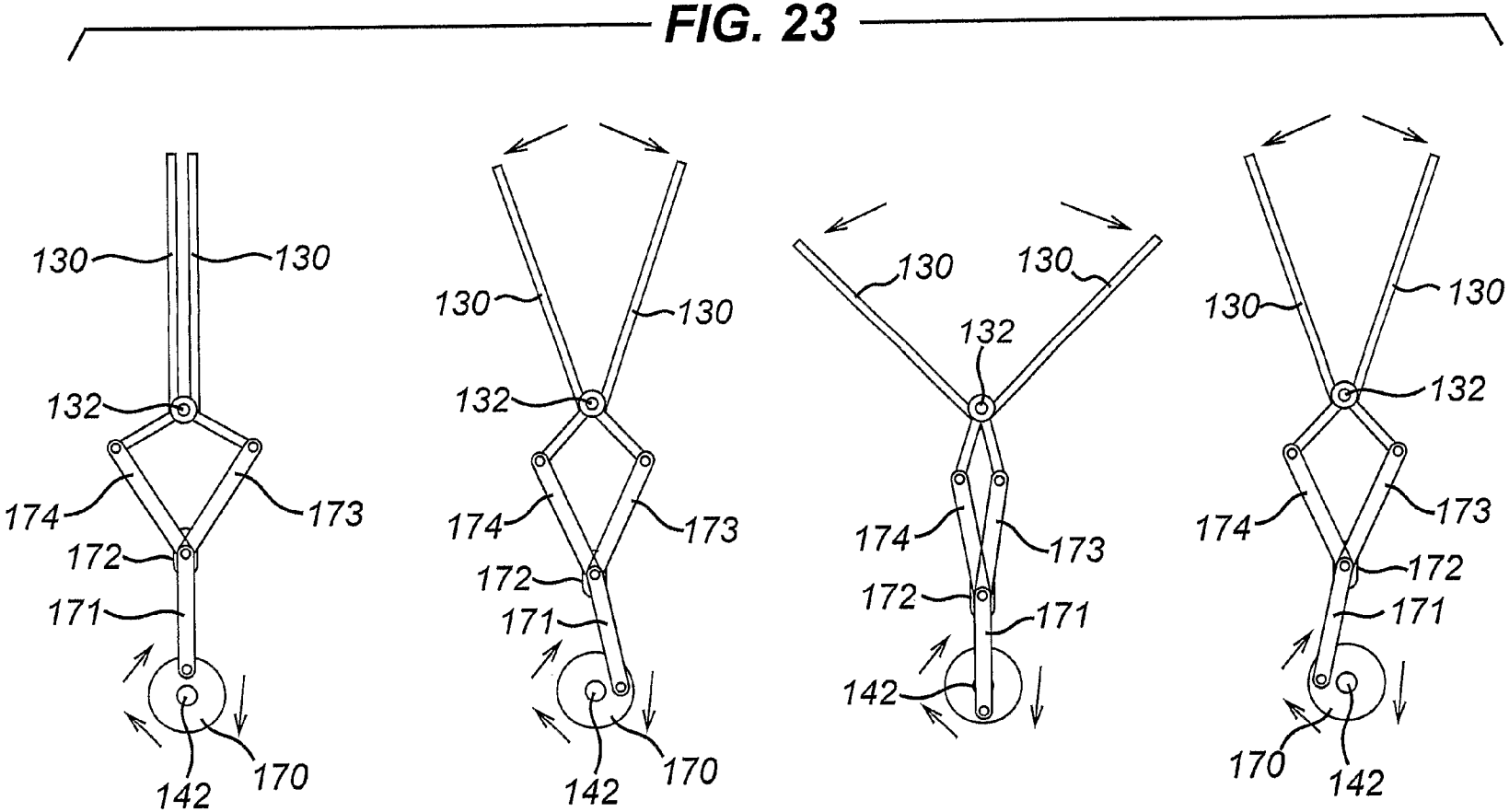
FIG. 23 shows front views of another alternative drive mechanism for the lighting system of FIG. 16 in four alternative positions.
Figure 24:
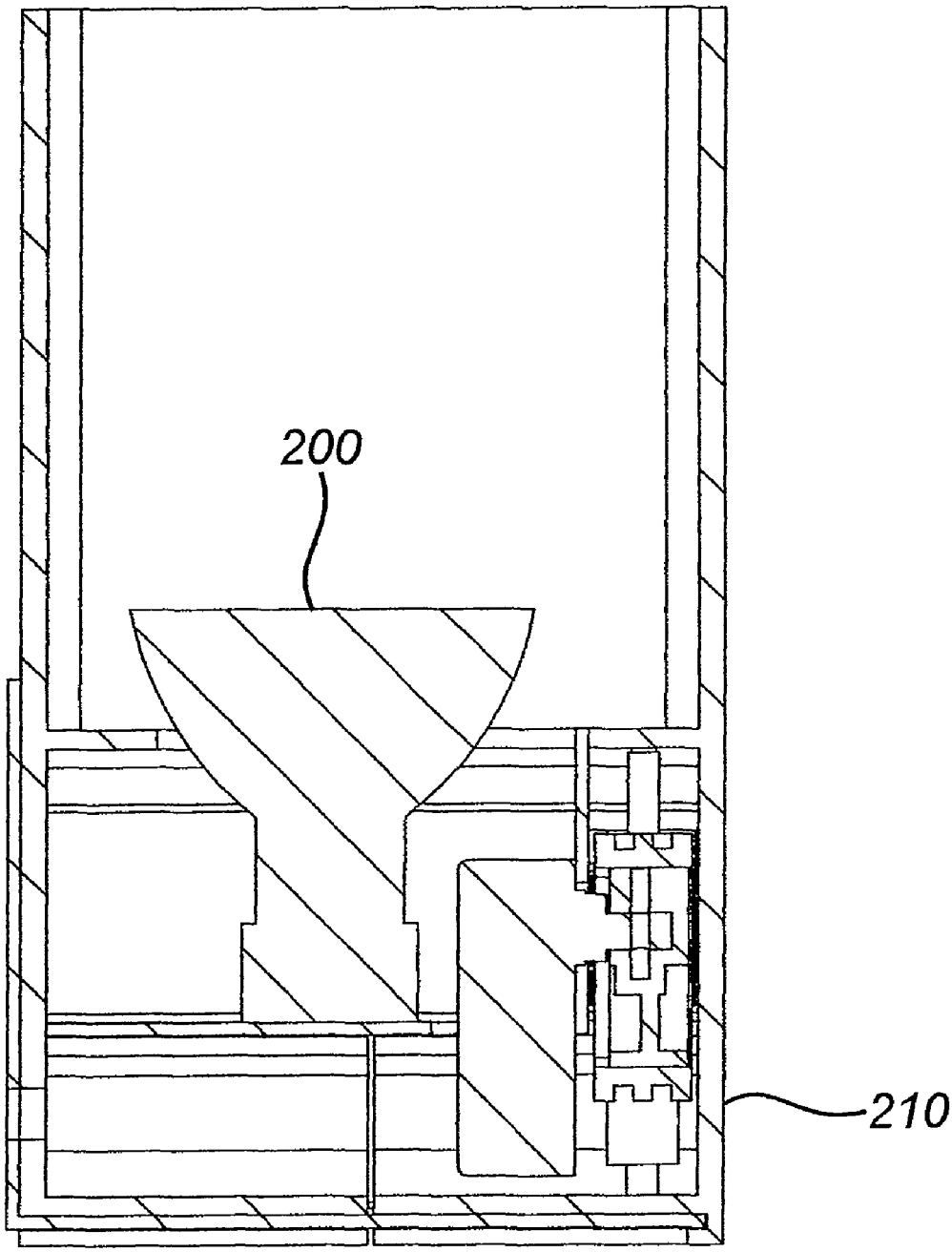
FIG. 24 shows a side view of an alternative lighting system.
Figure 25:
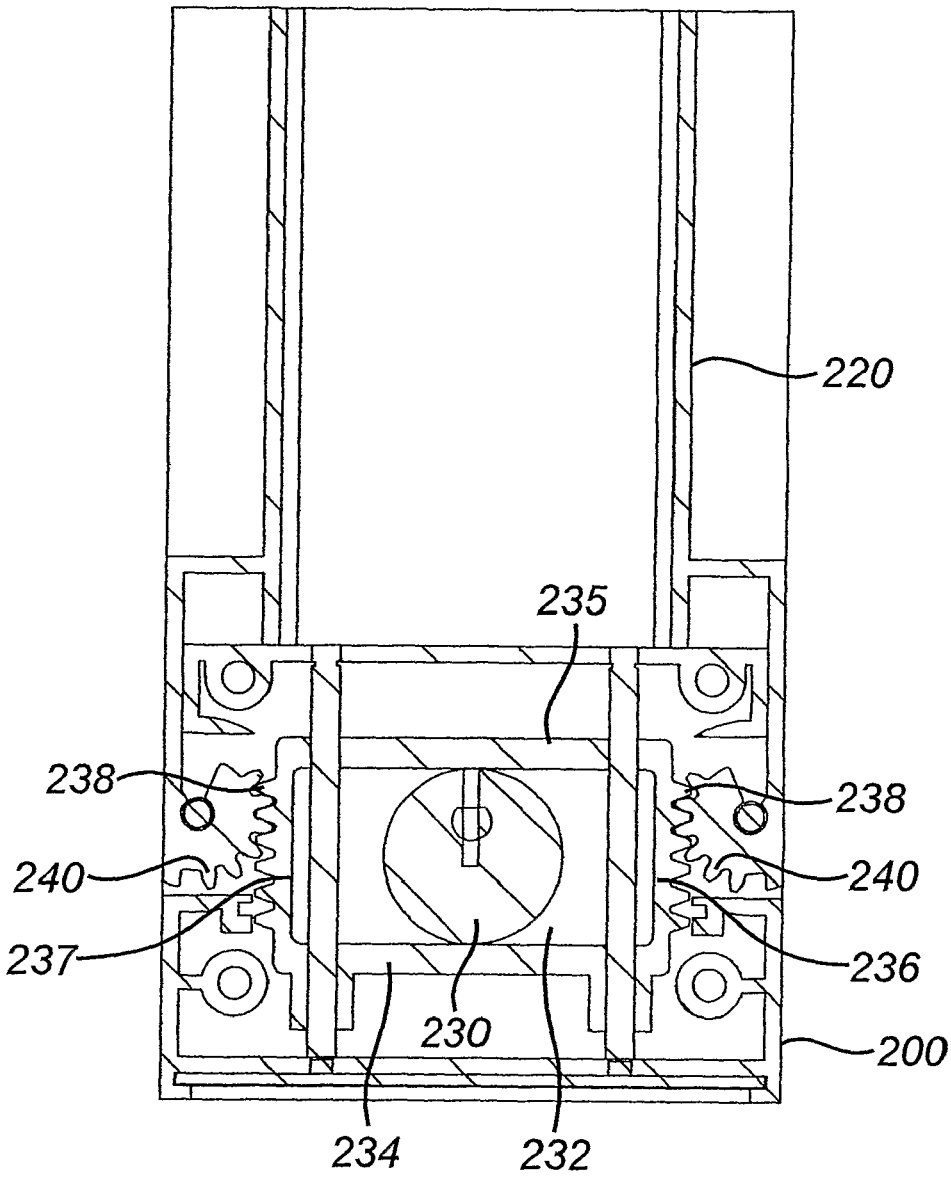
FIG. 25 shows a cross sectional front view of the lighting system of FIG. 24.
Figure 26:
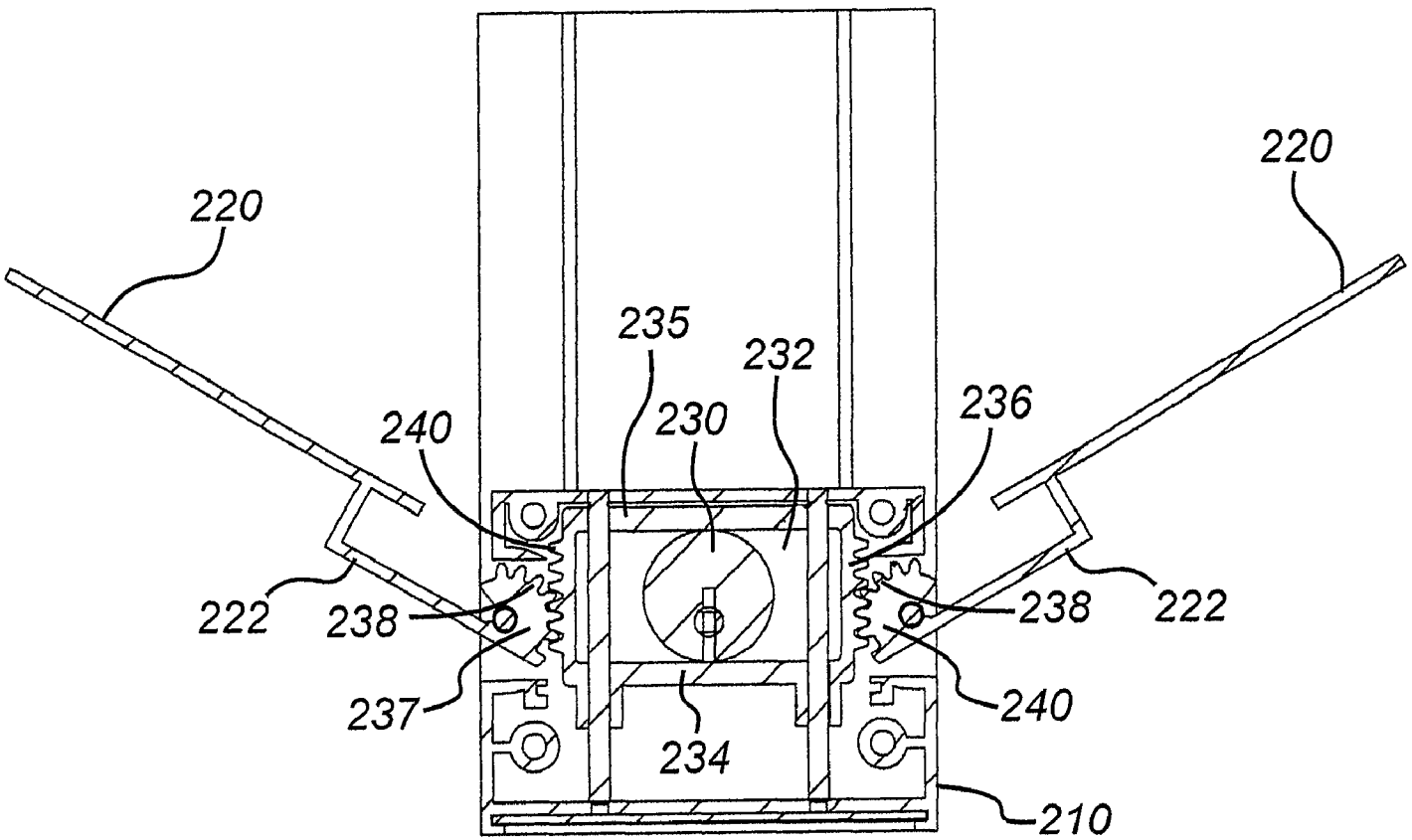
FIG. 26 shows a cross sectional front view of the lighting system of FIGS. 24 and 25 when the reflective surfaces have been opened out.
Figure 27:
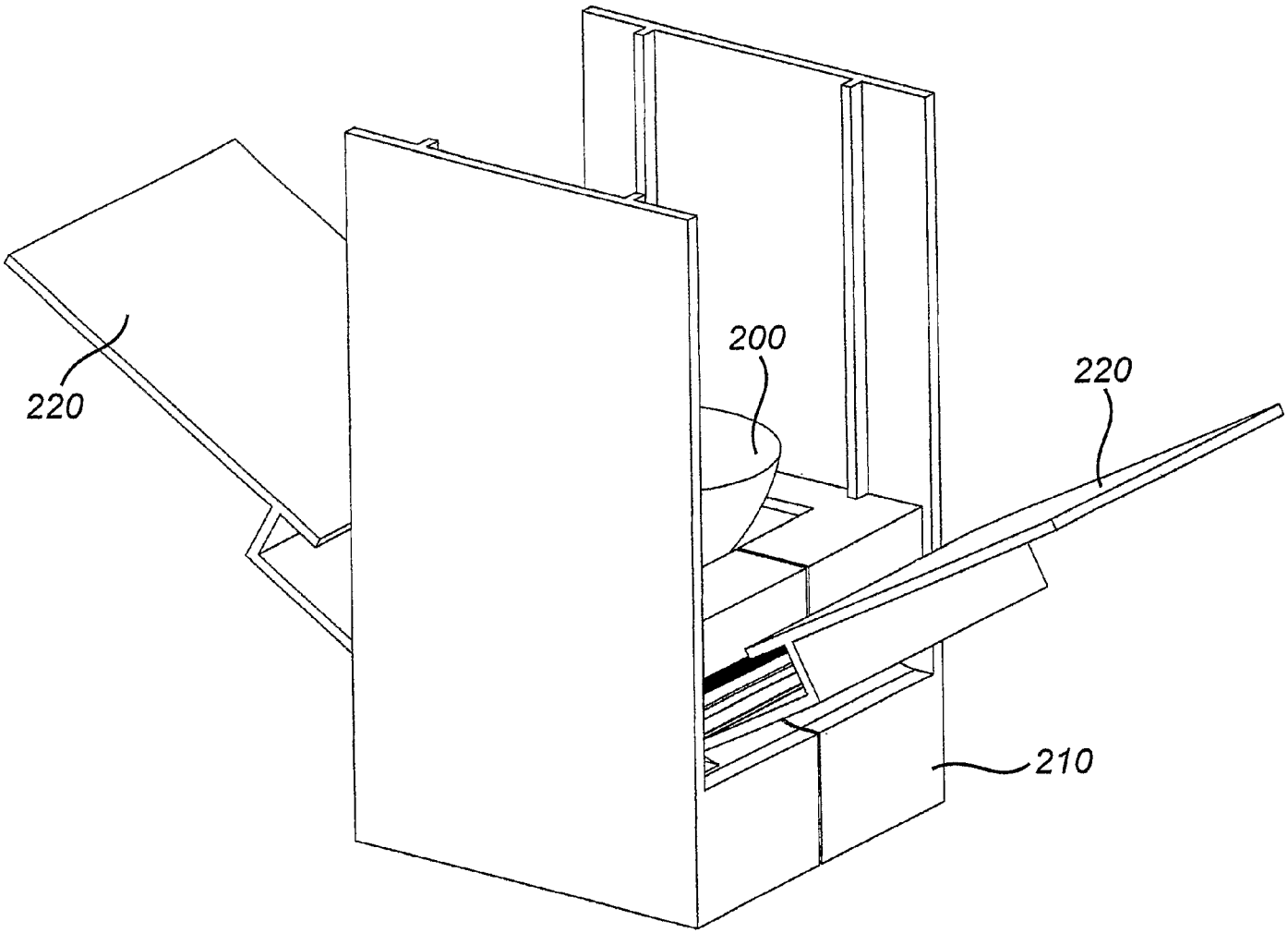
FIG. 27 shows a perspective view of the lighting system of FIGS. 24 to 26.

Another alternative drive mechanism for use with the lighting system of FIG. 16 is shown in FIG. 23. In this mechanism, the arms 130 are connected to the motor 140 via an arrangement of linkages 171, 173, 174. In particular, a disc 170 is connected to the drive shaft 142 of the motor 140. A first end of a first link 171 is connected to the disc 170 and a second end of the first link 171 is connected to a sliding pivot 172. First ends of second and third links 173, 174 are also connected to the sliding pivot 172 and second ends of the second and third links 173, 174 are connected to the first and second arms 130. The arms 130 are connected to one another and to the housing via a static pivot 132.

In use, rotation of the drive shaft 142 of the motor 140 causes the disc 170 to rotate which in turn causes the first end of the first link 171 to follow a circular path and the sliding pivot 172 to move back-and-forth. Movement of the sliding pivot 172 causes the first ends of the second and third linkages 173, 174 to move back-and-forth which causes the arms 130 to rotate about the fixed pivot 132 in a back-and-forth scissor motion. Rotation of the arms 130 about the fixed pivot 132 causes the shutters 120 to move in a back-and-forth motion across the aperture 102 in the housing 100 thus causing the angle of the light beam emitted from the lighting system to continuously increase and decrease. An alternative lighting system is shown in FIGS. 24 to 27. The lighting system comprises a light source 200 in a housing 210. The light source comprises a 240V 75 W dichroic halogen bulb. At either side of the light source 200 is located a shutter 220 connected to a drive mechanism housed within the housing 210 via an arm 222. The shutters 220 may be reflective. The drive mechanism allows the angle at which the shutters 220 are positioned relative to the housing 210 to be altered. This drive mechanism is capable of changing the position of the surfaces 220 over time.

The drive mechanism comprises an off centre cam 230 housed within a chamber 232 which is formed by four surfaces 234-237. Surfaces 236 and 237 are provided with racks 238 which mesh with pinions 240. Pinions 240 are connected to arms 222 and rotationally mounted on the housing 210. As the off centre cam rotates, the four surfaces 234-237 defining the chamber 232 are moved vertically. The vertical motion of the racks causes the pinions to rotate about their axes, thus causing the angle of the shutters 220 relative to the housing to change. Assuming the lighting system is mounted in the orientation shown in the figures, motion of the cam causes the racks to move cyclically upwards and downwards. Therefore, as the cam rotates, the shutters 220 move away from and towards the vertical in a cyclic motion. Because both shutters 220 are driven by the same cam, the two shutters 220 move together in unison. The cam is driven by a motor.

This drive-mechanism could also be used in the lighting system shown in FIG. 16.

In the embodiment shown in FIGS. 24 to 27, light from the light source 200 is emitted outwardly in all directions but is shuttered by the shutters 220. As the angle between the shutters and the central axis of the housing increases, the angle of the emitted beam increases. As the angle between the shutters and the central axis of the housing decreases, the angle of the emitted beam decreases.

In accordance with further embodiments, the invention includes:

a lighting system wherein the housing includes an aperture through which light can be emitted from the light source, and the or each shutter is movable within the aperture;

a lighting system wherein the drive mechanism includes a motor for driving the at least one arm;

a lighting system wherein the motor is arranged to drive the arms in a cyclic motion so that the or each shutter moves in a back-and-forth motion across the aperture;

a lighting system wherein the drive mechanism comprises a set of bevelled gears;

a lighting system wherein the drive mechanism includes a first bevelled gear connected to a drive shaft of the motor and a second bevelled gear attached to the at least one arm;

a lighting system, further comprising at least one switch for changing the direction of rotation of the motor;

a lighting system wherein the switch is actuable by the at least one arm;

a lighting system wherein the drive mechanism includes a magnetic drive mechanism;

a lighting system wherein the drive mechanism comprises a ferritic plate mounted on the end of the or each arm, wherein each arm is rotatably mounted about an axis, and further comprising a pair of magnets mounted on the drive shaft of the motor;

a lighting system wherein the drive mechanism comprises an arrangement of linkages connecting the or each arm to the motor.

It will of course be understood that the present invention has been described by way of example, and that modifications of detail can be made within the scope of the invention as defined by the following claims.

The invention claimed is:

1. A lighting system comprising:

a light source;

a deflector disposed within the path of a beam of light emitted by the light source;

a reflector moveable relative to the deflector; and a drive means for moving the reflector in a periodic motion relative to the deflector.

2. The lighting system of claim 1 wherein the reflector is formed from a plurality of rings of reflective facets, wherein each ring is formed from the surface of a paraboloid.

3. The lighting system of claim 2, wherein each of the plurality of rings is formed from a paraboloid having a different focal distance.

4. The lighting system of claim 3 wherein the focal distance of the rings decreases with distance, from the light source.

5. The lighting system of claim 4 wherein the foci of the plurality of rings are spaced along a central axis of the reflector.

6. The light system of claim 1 wherein the drive means comprises a cam in communication with the reflector for moving the reflector in a period motion relative to the deflector as the cam is rotated.

7. The lighting system of claim 6, wherein the cam is an off-centre circular cam.

8. The lighting system, of claim 6 wherein the cam is driven by a motor.

9. The lighting system of claim 1 wherein the deflector is cone shaped.

10. The lighting system of claim 9 wherein the cone is a regular cone.

11. The lighting system of claim 1 wherein the apex of the deflector cone faces the light source.

12. The lighting system of claim 1, wherein the axis of the deflector cone coincides with the axis of the reflector.

13. The lighting system of claim 1 wherein the axis of the deflector cone is movable relative to the axis of the reflector.

14. The lighting system of claim 1, further comprising a diffuser.

15. The lighting system of claim 14 wherein the diffuser comprises an opal glass-disc.

16. The lighting system of claim 14 wherein the diffuser is mounted on the deflector cone.

17. The lighting system of claim 1 wherein the deflector cone is injection-moulded with a plurality of support webs for mounting the deflector cone in the path of light emitted from the light source.

* * * * *